US008698726B2

(12) United States Patent
Yamamoto et al.

(10) Patent No.: US 8,698,726 B2
(45) Date of Patent: Apr. 15, 2014

(54) DISPLAY DEVICE AND METHOD FOR POWERING SAME

(75) Inventors: Kaoru Yamamoto, Osaka (JP); Seiji Kaneko, Osaka (JP); Yasuyuki Ogawa, Osaka (JP); Kohhei Tanaka, Osaka (JP); Seiichi Uchida, Osaka (JP); Yutaka Takamaru, Osaka (JP); Shigeyasu Mori, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/983,411

(22) PCT Filed: Jul. 25, 2012

(86) PCT No.: PCT/JP2012/068759

§ 371 (c)(1),
(2), (4) Date: Aug. 2, 2013

(87) PCT Pub. No.: WO2013/018597

PCT Pub. Date: Feb. 7, 2013

(65) Prior Publication Data

US 2013/0314390 A1 Nov. 28, 2013

(30) Foreign Application Priority Data

Aug. 2, 2011 (JP) ..... 2011-169049

(51) Int. Cl.
*G09G 3/36* (2006.01)

(52) U.S. Cl.
USPC ..... 345/99; 345/100; 345/211; 345/213

(58) Field of Classification Search
USPC ..... 345/87–100, 204–215, 690–699
See application file for complete search history.

(56) References Cited

U.S. PATENT DOCUMENTS

| | | | | |
|---|---|---|---|---|
| 2002/0180673 | A1 | 12/2002 | Tsuda et al. | |
| 2003/0117362 | A1 * | 6/2003 | An | 345/98 |
| 2004/0036669 | A1 | 2/2004 | Yanagi et al. | |
| 2005/0156862 | A1 * | 7/2005 | Hirayama et al. | 345/100 |
| 2006/0232541 | A1 * | 10/2006 | Kudo et al. | 345/98 |
| 2007/0035340 | A1 | 2/2007 | Kimura | |
| 2007/0091050 | A1 | 4/2007 | Katayama et al. | |
| 2007/0176869 | A1 | 8/2007 | Fujita | |
| 2013/0300722 | A1 * | 11/2013 | Gyouten et al. | 345/204 |

FOREIGN PATENT DOCUMENTS

| | | | |
|---|---|---|---|
| JP | 05-113774 | A | 5/1993 |
| JP | 2001-312253 | A | 11/2001 |
| JP | 2007-114496 | A | 5/2007 |

(Continued)

OTHER PUBLICATIONS

Official Communication issued in International Patent Application No. PCT/JP2012/068759, mailed on Oct. 23, 2012.

*Primary Examiner* — Dmitriy Bolotin
(74) *Attorney, Agent, or Firm* — Keating & Bennett, LLP

(57) ABSTRACT

There is provided an SSD display device with reduced power consumption. A selection circuit (400) consists of k selection blocks (410(1) to 410(k)). Each selection block consists of three thin-film transistors. The three thin-film transistors respectively have three phases of selection control signal (CT) provided to their gate terminals. A scanning period (T1) is provided and followed by an idle period (T2). In the idle period (T2), the three thin-film transistors in each selection block are brought into ON state in accordance with selection control signals (CT) at an idle period frequency (fck2). The idle period frequency (fck2) is lower than a scanning period frequency (fck1).

19 Claims, 12 Drawing Sheets

(56) References Cited

FOREIGN PATENT DOCUMENTS

| | | | |
|---|---|---|---|
| JP | 2007-206392 | A | 8/2007 |
| JP | 2010-102266 | A | 5/2010 |
| TW | 200405243 | A | 7/1992 |
| TW | 201112207 | A1 | 4/2011 |

* cited by examiner

DISPLAY DEVICE AND METHOD FOR POWERING SAME

TECHNICAL FIELD

The present invention relates to display devices and drive methods therefor, and the invention particularly relates to a display device and a method for powering same in which groups of video signal lines are provided with a video signal that is common among the groups, such that the signal is applied to the lines in each group in a time-division manner.

BACKGROUND ART

One of the conventionally known methods for driving display devices, such as liquid crystal display devices, is a method called SSD (source-shared driving; referred to below as an "SSD method"). In a liquid crystal display device employing the SSD method, a plurality of output terminals of a source driver (video signal line driver circuit) for driving a plurality of source lines (video signal lines) on a liquid crystal panel are connected to a selection circuit consisting of a plurality of switching elements such as thin-film transistors. Each output terminal of the source driver is connected to a predetermined number of the thin-film transistors. The thin-film transistors in the selection circuit are connected to a plurality of source lines. Specifically, in this liquid crystal display device, groups of the predetermined number of source lines are connected to the output terminals of their common source driver via the predetermined number of thin-film transistors. Moreover, a video signal that is common among the groups is provided to the source driver, and the selection circuit applies the video signal to the source lines in a time-division manner. By employing the SSD method as above, it is rendered possible to reduce the number of output terminals of the source driver.

Patent Document 1 discloses a liquid crystal display device employing the SSD method and having the selection circuit integrally formed with a liquid crystal panel. In the following, such a liquid crystal display device with the selection circuit integrally formed with a liquid crystal panel (display portion) will be referred to as a "liquid crystal display device with a monolithic selection circuit". This liquid crystal display device with a monolithic selection circuit allows a frame area reduction and a cost reduction. For example, thin-film transistors using amorphous silicon (a-Si) for their semiconductor layers (referred to below as "a-Si TFTs ") are used as driver elements of the liquid crystal display device with a monolithic selection circuit, as disclosed in Patent Document 1.

Incidentally, Patent Document 2 discloses a display device drive method in which a scanning period T1 for scanning gate lines (scanning signal lines) is followed by an idle period T2 in which no gate lines are scanned. During the idle period T2, clock signals, etc., are not provided to a gate driver (scanning signal line driver circuit), so that image rewriting is not performed. Accordingly, even in the case where the gate lines are scanned at 60 Hz during the scanning period T1, when the idle period T2, which has, for example, the same length as the scanning period T1, is provided, the overall frequency for driving the gate lines is about 30 Hz. Thus, a reduction in power consumption can be achieved.

CITATION LIST

Patent Documents

Patent Document 1: Japanese Laid-Open Patent Publication No. 2010-102266

Patent Document 2: Japanese Laid-Open Patent Publication No. 2001-312253

SUMMARY OF THE INVENTION

Problems to be Solved by the Invention

Conventionally, there is demand for electronic equipment such as display devices to consume lower power.

Therefore, an objective of the present invention is to provide a low power-consumption display device employing the SSD method (referred to below as an "SSD display device") and a drive method therefor.

Solution to the Problems

A first aspect of the present invention is directed to a display device comprising:

a display portion that includes a plurality of video signal lines and a plurality of scanning signal lines crossing the video signal lines;

a scanning signal line driver circuit that drives the scanning signal lines such that a scanning period in which the scanning signal lines are sequentially selected and an idle period in which none of the scanning signal lines is selected alternatingly occur in cycles of a frame period consisting of the scanning period and the idle period;

a selection circuit that is integrally formed with the display portion and includes a plurality of selection blocks;

a video signal line driver circuit that provides the selection blocks with their respective video signals; and a display control circuit that provides the video signal line driver circuit with image data corresponding to the video signals and provides the selection blocks with a plurality of selection control signals cyclically repeating on-state and off-state levels, wherein, each selection block provides the video signal received thereby to video signal lines that are adjacent to each other in a video signal line group in a time-division manner in accordance with the selection control signals, the video signal line group consisting of as many video signal lines as the number of selection control signals, and the display control circuit generates the selection control signals so as to keep the selection control signals at a lower frequency during the idle period than during the scanning period.

In a second aspect of the present invention, based on the first aspect of the invention, the display control circuit generates the selection control signals so as to keep the selection control signals in a smaller amplitude during the idle period than during the scanning periods.

In a third aspect of the present invention, based on the first aspect of the invention, the idle period is longer than the scanning period.

In a fourth aspect of the present invention, based on the first aspect of the invention, the video signal line driver circuit sets the video signals at a constant potential during the idle period.

In a fifth aspect of the present invention, based on the first aspect of the invention, each selection block has a plurality of switching elements with their respective first conductive terminals connected to the video signal lines in the video signal line group that corresponds to that selection block, a video signal received by each selection block is provided to second conductive terminals of the switching elements in that selection block, and the display control circuit provides the selection control signals to the switching elements in the selection block.

In a sixth aspect of the present invention, based on the fifth aspect of the invention, the display portion displays an image based on a plurality of primary colors, and the video signal lines in each video signal line group respectively correspond to the primary colors.

In a seventh aspect of the present invention, based on the sixth aspect of the invention, the number of the primary colors is three, each video signal line group consists of three video signal lines, each selection block has three switching elements, and the three video signal lines in each video signal line group respectively correspond to the three primary colors.

In an eighth aspect of the present invention, based on the fifth aspect of the invention, the display portion displays an image based on a plurality of primary colors, and the video signal lines in each video signal line group respectively correspond to as many primary colors from among a predetermined number of primary colors greater than the number of video signal lines in the video signal line group, and also respectively correspond to the same number of other primary colors from among the predetermined number of primary colors.

In a ninth aspect of the present invention, based on the eighth aspect of the invention, the number of the primary colors is four, each video signal line group consists of two video signal lines, each selection block has two switching elements, and the two video signal lines in each video signal line group respectively correspond to two of the four primary colors and also respectively correspond to the other two of the four primary colors.

In a tenth aspect of the present invention, based on the fifth aspect of the invention, the display portion displays an image based on a plurality of primary colors, and each video signal line group consists of video signal lines whose number is an integral multiple of the number of the primary colors.

In an eleventh aspect of the present invention, based on the tenth aspect of the invention, the number of the primary colors is three, each video signal line group consists of six video signal lines, each selection block has six switching elements, and three of the video signal lines in each video signal line group respectively correspond to the three primary colors and the other three video signal lines in the video signal line group respectively correspond to the three primary colors.

In a twelfth aspect of the present invention, based on the first aspect of the invention, the selection circuit consists of:

a first selection circuit positioned to one side of the display portion; and a second selection circuit positioned to the other side of the display portion.

In a thirteenth aspect of the present invention, based on any of the first through twelfth aspects of the invention, the selection circuit is implemented with thin-film transistors having semiconductor layers made of an oxide semiconductor.

In a fourteenth aspect of the present invention, based on any of the first through twelfth aspects of the invention, the selection circuit is implemented with thin-film transistors having semiconductor layers made of amorphous silicon.

A fifteenth aspect of the present invention is directed to a drive method for a display device provided with a display portion that includes a plurality of video signal lines and a plurality of scanning signal lines crossing the video signal lines, a scanning signal line driver circuit that drives the scanning signal lines, a selection circuit that is integrally formed with the display portion and includes a plurality of selection blocks, a video signal line driver circuit that provides the selection blocks with their respective video signals, and a display control circuit that provides the video signal line driver circuit with image data corresponding to the video signals and provides the selection blocks with a plurality of selection control signals cyclically repeating on-state and off-state levels, the method comprising the steps of:

driving the scanning signal lines such that a scanning period in which the scanning signal lines are sequentially selected and an idle period in which none of the scanning signal lines is selected alternatingly occur in cycles of a frame period consisting of the scanning period and the idle period;

providing the video signal received by the selection block to video signal lines that are adjacent to each other in a video signal line group in a time-division manner in accordance with the selection control signals, the video signal line group consisting of as many video signal lines as the number of selection control signals; and keeping the selection control signals at a lower frequency during the idle period than during the scanning period.

In a sixteenth aspect of the present invention, based on the fifteenth aspect of the invention, the selection control signals are kept in a smaller amplitude during the idle period than during the scanning periods.

In a seventeenth aspect of the present invention, based on the fifteenth aspect of the invention, the idle period is longer than the scanning period.

In an eighteenth aspect of the present invention, based on the fifteenth aspect of the invention, the video signals are set at a constant potential during the idle period.

Effect of the Invention

In the display device according to the first aspect of the present invention, the display portion is integrally formed with the selection circuit, each selection block in the selection circuit provides video signals to a plurality of video signal lines in a video signal line group in a time-division manner, and one frame period consists of the scanning period and the idle period. The selection control signals are kept at a lower frequency during the idle period than during the scanning period. As a result, the frequency at which to drive the selection circuit is reduced over the entire frame period. Thus, power consumption is reduced. Moreover, the display portion is monolithically formed with the selection circuit, resulting in a reduced frame area and reduced cost of the selection circuit.

According to the second aspect of the present invention, the selection control signals are kept in a smaller amplitude during the idle period than during the scanning periods. Thus, a further reduction in power consumption can be achieved.

According to the third aspect of the present invention, the idle period is longer than the scanning period. Thus, a further reduction in power consumption can be achieved.

According to the fourth aspect of the present invention, the video signals are set at a constant potential during the idle period, so that a similar effect to that achieved by the first aspect of the present invention can be achieved.

According to the fifth aspect of the present invention, the selection block can be realized by a plurality of switching elements. Here, video signals are provided to a video signal line group (a plurality of video signal lines) during the idle period in accordance with a plurality of control signals. Accordingly, the effect of noise or suchlike on the video signal lines is reduced during the idle period. Thus, it is possible to inhibit a reduction in display quality. Moreover, the selection control signals are kept at a lower frequency during the idle period than during the scanning period, resulting in a reduced load on the switching elements. Thus, threshold variations in the switching elements can be reduced, so that a reduction in reliability of the switching elements can be inhibited.

The sixth aspect of the present invention allows a similar effect to that achieved by the fifth aspect of the invention to be achieved in a display device which provides image display based on a plurality of primary colors.

The seventh aspect of the present invention makes it possible to provide image display based on three primary colors.

The eighth aspect of the present invention allows a similar effect to that achieved by the fifth aspect of the invention to be achieved in a display device which provides image display based on a plurality of primary colors with each video signal line corresponding to more than one primary color.

According to the ninth aspect of the present invention, each video signal line corresponds to two primary colors, so that image display based on four primary colors can be provided.

According to the tenth aspect of the present invention, the number of outputs of the video signal line driver circuit is reduced, resulting in a further cost reduction.

According to the eleventh aspect of the present invention, image display based on three primary colors can be provided.

According to the twelfth aspect of the present invention, the size of the selection circuit can be approximately halved in the direction in which the scanning signal line extends. As a result, the layout pitch in the direction in which the scanning signal line extends is doubled. Thus, it is possible to achieve, for example, a higher-definition display portion.

According to the thirteenth aspect of the present invention, the selection circuit is implemented with thin-film transistors having semiconductor layers made of an oxide semiconductor. The control signals can be set at a further lower frequency during the idle period because the leakage current of the thin-film transistors is significantly low. As a result, a further reduction in power consumption can be achieved. Moreover, the on-state current of the thin-film transistors having semiconductor layers made of an oxide semiconductor is significantly high, and therefore, the thin-film transistors can be reduced to a significantly small size. Thus, a further reduction in frame area can be achieved.

According to the fourteenth aspect of the present invention, the selection circuit is implemented with thin-film transistors having semiconductor layers made of amorphous silicon. Thus, a further cost reduction can be achieved.

The fifteenth through eighteenth aspects of the present invention allows similar effects to those achieved by the first through fourth aspects of the invention to be achieved with a drive method for a display device.

MODES FOR CARRYING OUT THE INVENTION

Hereinafter, embodiments of the present invention will be described with reference to the accompanying drawings. Note that in the following descriptions, a gate terminal, a drain terminal, and a source terminal of a thin-film transistor correspond to a control terminal, a first conductive terminal, and a second conductive terminal. Moreover, the descriptions will be given on the premise that all thin-film transistors are of an n-channel type.

<1 First Embodiment>

<1.1 Overall Configuration and Operation>

Figure 1:
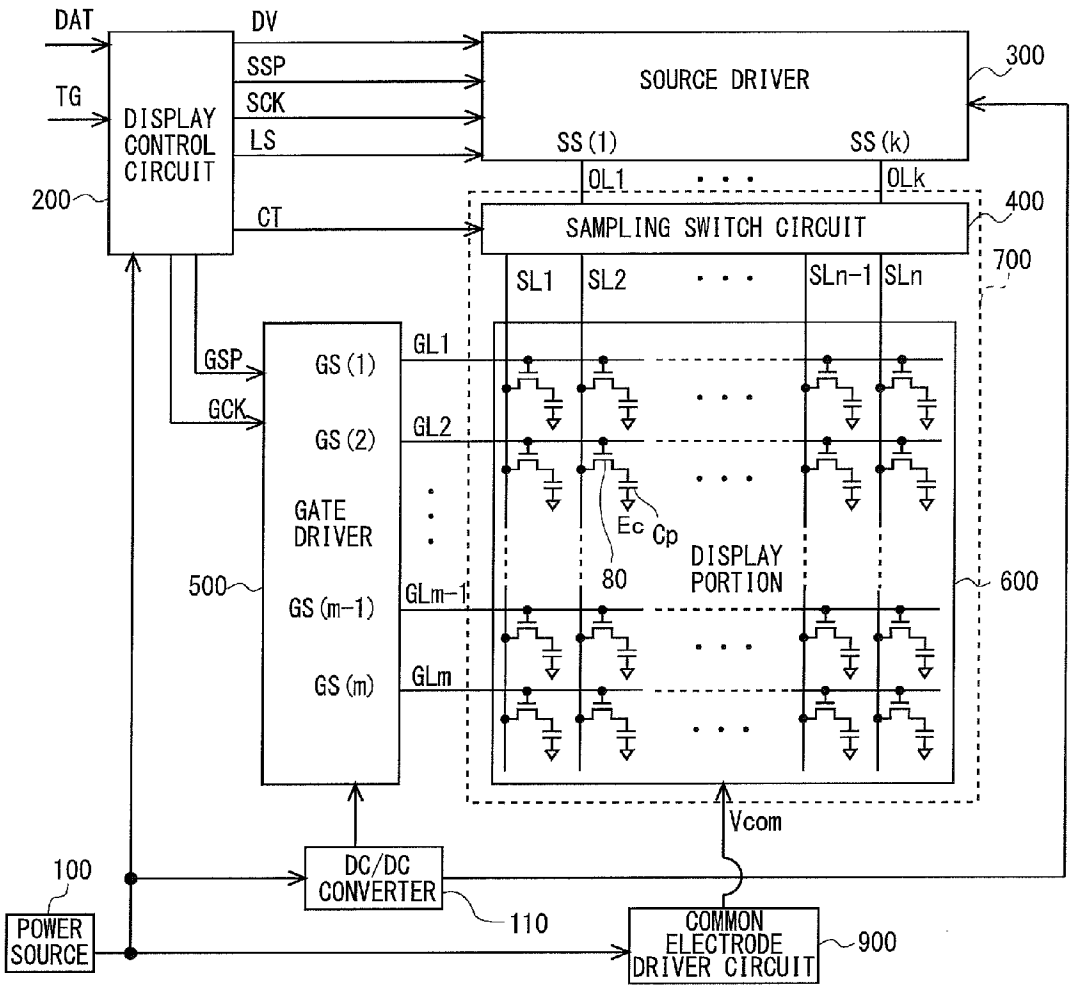
FIG. 1 is a block diagram illustrating the overall configuration of a liquid crystal display device according to a first embodiment of the present invention.

FIG. 1 is a block diagram illustrating the overall configuration of an active-matrix liquid crystal display device according to a first embodiment of the present invention. This liquid crystal display device includes a power source 100, a DC/DC converter 110, a display control circuit 200, a source driver (video signal line driver circuit) 300, a selection circuit (sampling switch circuit) 400, a gate driver (scanning signal line driver circuit) 500, a display portion 600, and a common electrode driver circuit 900. The liquid crystal display device according to the present embodiment is a liquid crystal display device employing a so-called SSD (source-shared driving) method in which source lines (video signal lines) are divided into groups of a predetermined number, and each group is connected to the source driver 300 via the selection circuit 400.

The selection circuit 400 is formed of, for example, amorphous silicon, polycrystalline silicon, microcrystalline silicon, or oxide semiconductor (e.g., IGZO) on a liquid crystal display panel 700, which includes the display portion 600. Specifically, the liquid crystal display device according to the present embodiment is a liquid crystal display device with amonolithic selection circuit in which the selection circuit 400 and the display portion 600 are formed on the same board (an array board, which is one of two boards included in the liquid crystal display panel) . Therefore, the frame area of the liquid crystal display device can be reduced. Note that the source driver 300 and/or the gate driver 500 may also be formed of, for example, amorphous silicon, polycrystalline silicon, microcrystalline silicon, or oxide semiconductor on the liquid crystal display panel 700. Specific implementation examples using amorphous silicon and IGZO will be described later.

The display portion 600 has formed thereon n source lines (video signal lines) $SL_1$ to $SL_n$, m gate lines (scanning signal lines) $GL_1$ to $GL_m$, and m×n pixel forming portions corresponding to intersections of the source lines $SL_1$ to $SL_n$ and the gate lines $GL_1$ to $GL_m$ . The m×n pixel forming portions are arranged in a matrix so as to form pixel arrays. Each pixel forming portion includes a pixel thin-film transistor 80, which is a switching element with a gate terminal connected to the gate line that passes through its corresponding intersection and a source terminal connected to the source line that passes through the intersection, a pixel electrode connected to a drain terminal of the pixel thin-film transistor 80, a common electrode Ec, which is an opposing electrode commonly provided for the pixel forming portions, and a liquid crystal layer commonly provided for the pixel forming portions between the pixel electrode and the common electrode Ec. Moreover, liquid crystal capacitance is created by the pixel electrode and the common electrode Ec as pixel capacitance Cp. Note that to reliably hold a voltage in the pixel capacitance Cp, auxiliary capacitance is normally provided in parallel with the liquid crystal capacitance, but the auxiliary capacitance is not directly relevant to the present invention, and therefore, any description and illustration thereof will be omitted.

The liquid crystal display device according to the present embodiment provides a color image based on the three primary colors R, G, and B. Accordingly, the pixel forming portions are divided into groups of three respectively corresponding to R, G, and B. Each of the groups forms one pixel. In the following, the pixel forming portions corresponding to R, G, and B will be referred to as the "R-pixel forming portion", the "G-pixel forming portion", and the "B-pixel forming portion", respectively.

The power source 100 supplies a predetermined source voltage to the DC/DC converter 110, the display control circuit 200, and the common electrode driver circuit 900. On the basis of the source voltage, the DC/DC converter 110 generates a predetermined direct-current voltage for operating the source driver 300 and the gate driver 500, and supplies the voltage to the source driver 300 and the gate driver 500. The common electrode driver circuit 900 provides a predetermined potential Vcom to the common electrode Ec.

The display control circuit 200 receives externally transmitted signals, including an image signal DAT and a timing signal group TG such as horizontal and vertical synchronization signals, and outputs digital video signals DV (image data), along with signals for controlling image display on the display portion 600, which include a source start pulse signal SSP, a source clock signal SCK, a latch strobe signal LS, a selection control signal CT, a gate start pulse signal GSP, and a gate clock signal GCK. The high- and low-level potentials of the selection control signal CT are Vdd and Vss potentials, respectively.

In the present embodiment, the selection control signal CT consists of three phases of selection control signal CTr, CTg, and CTb. The selection control signals CTr, CTg, and CTb respectively correspond to the R-, G-, and B-pixel forming portions. In the following, the selection control signal CTr will be referred to as the "R-selection control signal", the selection control signal CTg will be referred to as the "G-selection control signal", and the selection control signal CTb will be referred to as the "B-selection control signal". Moreover, for the R-selection control signal CTr, the G-selection control signal CTg, and the B-selection control signal CTb, a period after transition from low to high-level potential until transition from high to low-level potential will be referred to as a "switching selection period" for convenience sake. The R-selection control signal CTr, the G-selection control signal CTg, and the B-selection control signal CTb are out of phase by one switching selection period from one another, and each of them is set at high-level potential (Vdd potential) for one of the three switching selection periods (except for during the idle period T2 to be described later). In the present embodiment, three switching selection periods correspond to one horizontal scanning period.

The source driver 300 receives the digital video signals DV, the source start pulse signal SSP, the source clock signal SCK, and the latch strobe signal LS outputted by the display control circuit 200, and provides video signals SS(1) to SS(k) to k output signal lines $OL_1$ to $OL_k$, respectively. Here, in the present embodiment, k=n/3. Note that the source driver will be described in detail later.

The selection circuit 400 receives the R-selection control signal CTr, the G-selection control signal CTg, and the B-selection control signal CTb outputted by the display control circuit 200, in addition to the video signals SS(1) to SS(k) outputted by the source driver 300, and applies the video signals SS(1) to SS(k) to the source lines $SL_1$ to $SL_n$ in a time-division manner. Note that the selection circuit 400 will be described in detail below.

In accordance with the gate start pulse signal GSP and the gate clock signal GCK outputted by the display control circuit 200, the gate driver 500 repeats applying scanning signals GS(1) to GS(m) at high-level potential to the gate lines $GL_1$ to GLm, respectively, in cycles of one frame period.

In this manner, the video signals SS(1) to SS(k) are applied to the source lines $SL_1$ to $SL_n$ in a time-division manner, and the scanning signals GS(1) to GS(m) are applied to the gate lines $GL_1$ to $GL_m$, respectively, so that the display portion 600 displays an image based on the externally transmitted image signal DAT.

<1.2 Configuration and Operation of the Source Driver>

Figure 2:
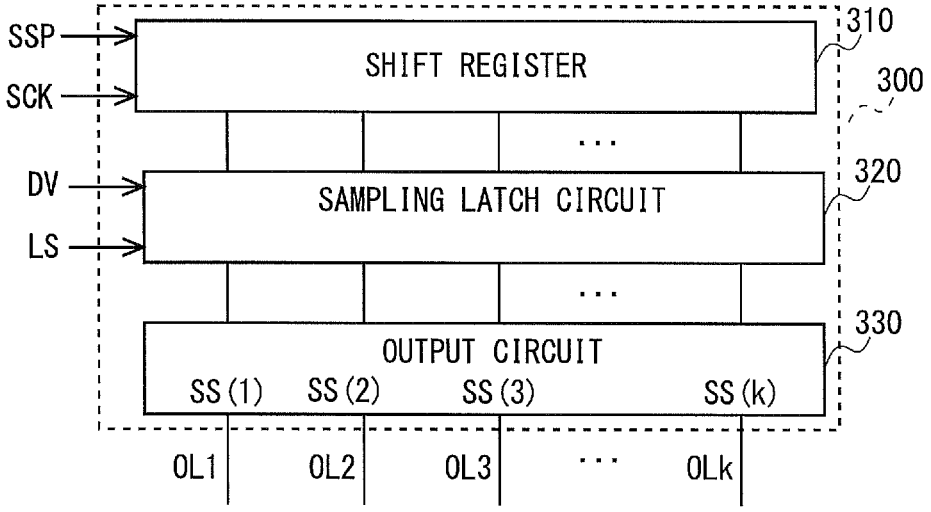
FIG. 2 is a block diagram illustrating the configuration of a source driver in the first embodiment.

FIG. 2 is a block diagram illustrating the configuration of the source driver 300 in the present embodiment. As shown in FIG. 2, the source driver 300 consists of a shift register 310, whose stages are equal in number to output signal lines $OL_1$ to $OL_k$, a sampling latch circuit 320 connected to the shift register 310, and an output circuit 330 connected to the sampling latch circuit 320 and the output signal lines $OL_1$ to $OL_k$.

The shift register 310 receives a source start pulse signal SSP and a source clock signal SCK outputted by the display control circuit 200. In accordance with the source start pulse signal SSP and the source clock signal SCK, the shift register 310 sequentially transfers pulses included in the source start pulse signal SSP from its input to output terminal during each of three switching selection periods within each horizontal scanning period. In response to the transfer, sampling pulses are sequentially provided to the sampling latch circuit 320.

The sampling latch circuit 320 receives digital video signals DV and a latch strobe signal LS outputted by the display control circuit 200, in addition to the sampling pulses outputted by the shift register 310. The sampling latch circuit 320 holds the digital video signals DV in timing with the sampling pulses, and then latches the signals in accordance with the latch strobe signal LS so as to hold each of the signals for one switching selection period (⅓ of a horizontal scanning period). Here, the digital video signals DV that are to be held are, for example, 8-bit data for their corresponding colors. The digital video signals DV that have been held are provided to the output circuit 330.

The output circuit 330 converts the digital video signals DV received from the sampling latch circuit 320 into analog signals representing, for example, 256 tones, which are outputted to the output signal lines $OL_1$ to $OL_k$, respectively as video signals SS(1) to SS(k). Note that in the present embodiment, the video signals SS(1) to SS(k) are set at a potential corresponding to the R-pixel forming portion during the first of the switching selection periods within each horizontal scanning period (referred to below as the "first switching selection period"), at a potential corresponding to the G-pixel forming portion during the second of the switching selection periods within each horizontal scanning period (referred to below as the "second switching selection period") , and at a potential corresponding to the B-pixel forming portion during the third of the switching selection periods within each horizontal scanning period (referred to below as the "third switching selection period"). Moreover, the output circuit 330 may perform a level shifting operation or suchlike to shift the potential of the video signals.

<1.3 Configuration of the Selection Circuit>

Figure 3:
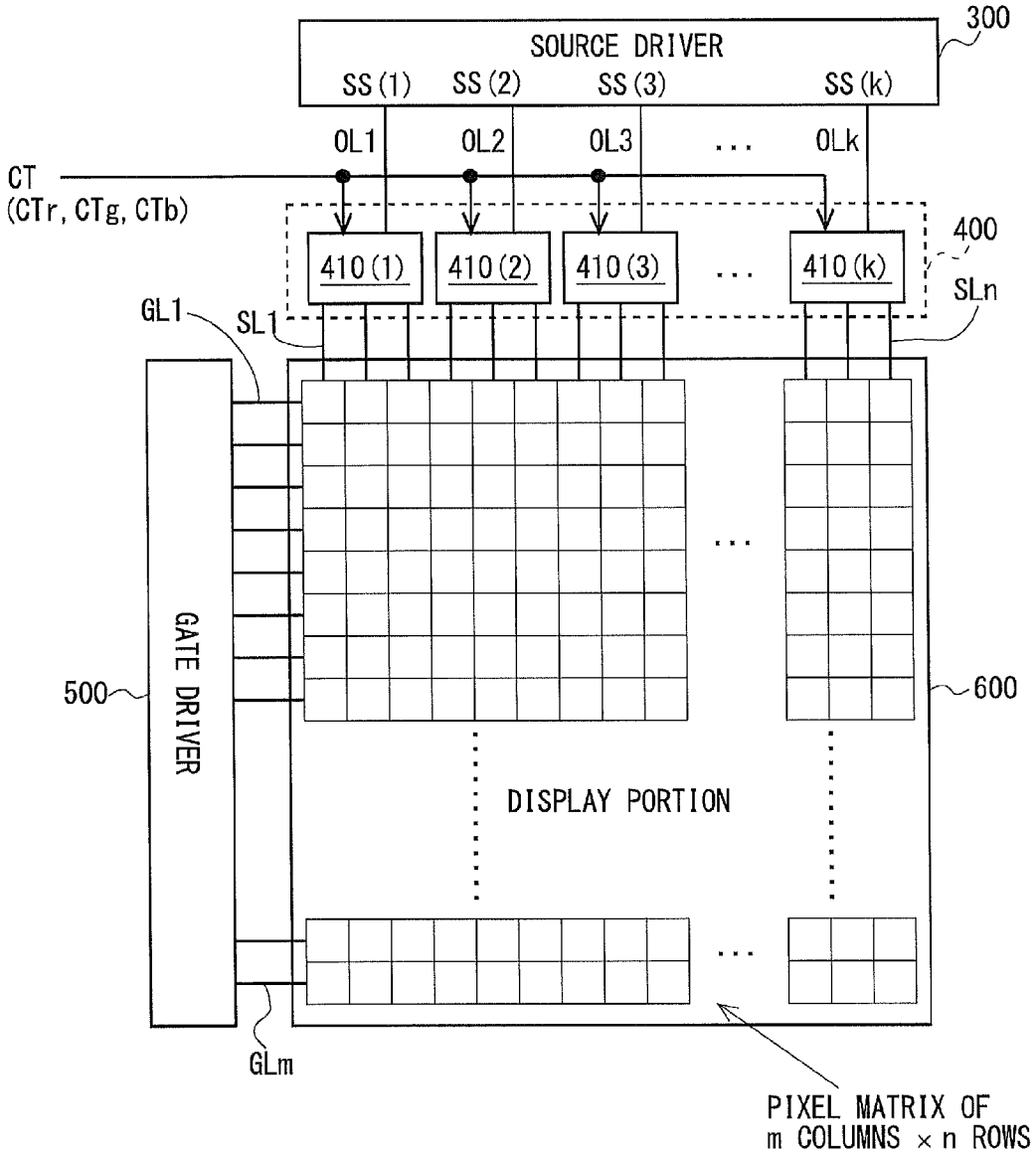
FIG. 3 is a block diagram describing the configuration of a selection circuit in the first embodiment.

FIG. 3 is a block diagram describing the configuration of the selection circuit 400 in the present embodiment. As shown in FIG. 3, the selection circuit 400 consists of k selection blocks 410(1) to 410(k). The display portion 600 has a pixel matrix of m rows and n columns formed as described above, and the selection blocks are provided in three-to-one correspondence with the columns of the pixel matrix.

The selection blocks 410(1) to 410(k) are respectively connected (correspond) to the output signal lines $OL_1$ to $OL_k$.

Moreover, each of the selection blocks 410(1) to 410(k) is connected to three different source lines. The selection block 410(j) is connected to source lines $SL_{3j-2}$ to $SL_{3j}$ (j=1 to k). Each selection block is provided with the R-selection control signal CTr, the G-selection control signal CTg, and the B-selection control signal CTb.

Figure 4:
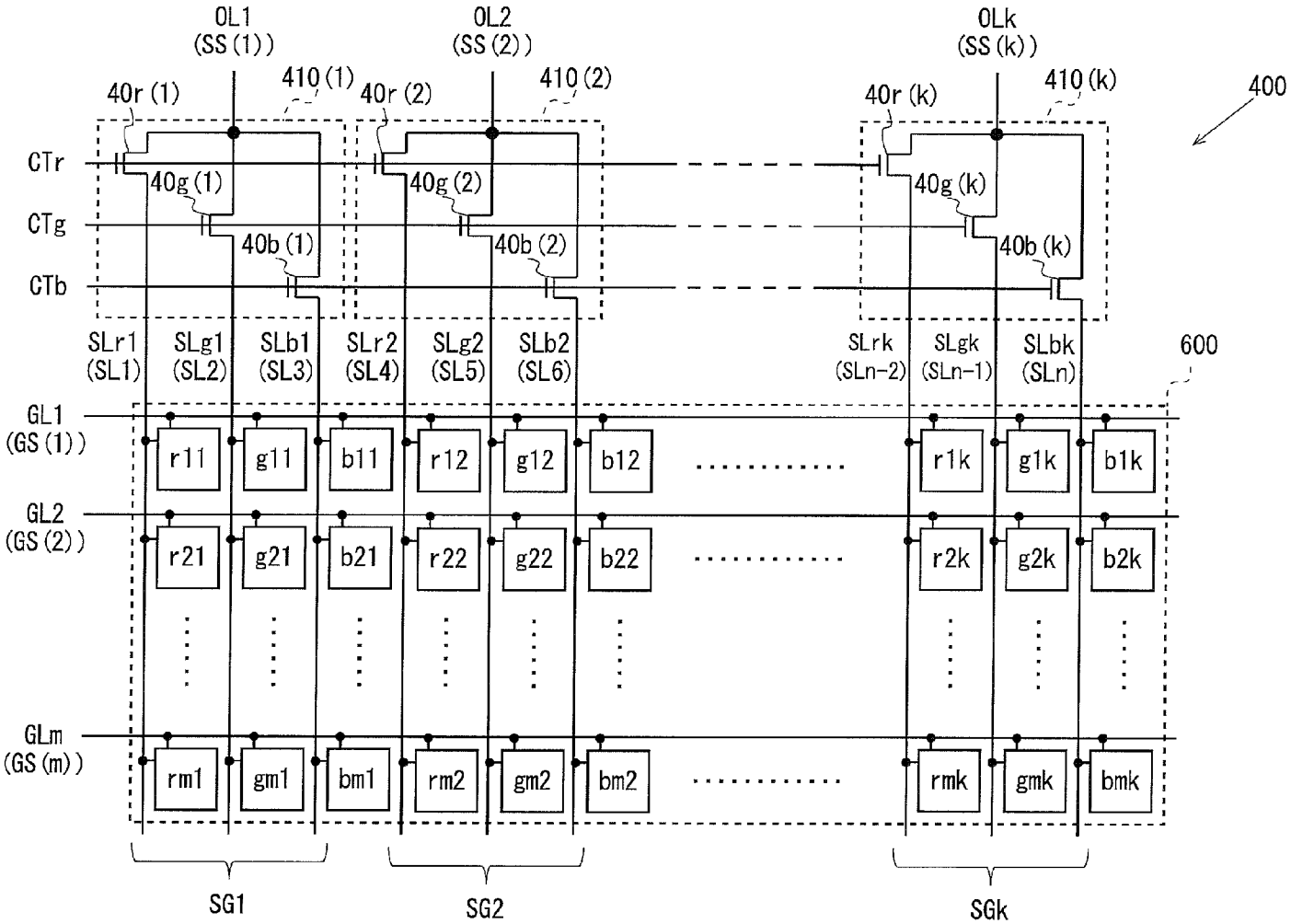
FIG. 4 is a circuit diagram describing the correspondence between selection blocks and source lines in the first embodiment.

FIG. 4 is a circuit diagram describing the correspondence between the selection blocks 410(1) to 410(k) and the source lines $SL_1$ to $SL_n$, in the present embodiment. As shown in FIG. 4, the source lines $SL_1$ to $SL_n$ are divided into groups $SG_1$ to $SG_k$ of three source lines. Here, the source line group $SG_j$ consists of three source lines $SL_{3j-2}$ to $SL_{3j}$. The source line groups $SG_1$ to $SG_k$ respectively correspond to the selection blocks 410(1) to 410(k).

In FIG. 4, among the source line group $SG_j$, the source line that corresponds to R (referred to below as the "R-source line") is denoted by the characters $SLr_j$, the source line that corresponds to G (referred to below as the "G-source line") is denoted by the characters $SLg_j$, and the source line that corresponds to B (referred to below as the "B-source line") is denoted by the characters $SLb_j$. Moreover, the R-pixel forming portion that is provided so as to correspond to the intersection of the R-source line $SLr_j$ and the gate line $GL_i$ is denoted by the characters $r_{ij}$ (i=1 to m), the G-pixel forming portion that is provided so as to correspond to the intersection of the G-source line $SLg_j$ and the gate line $GL_i$ is denoted by the characters $g_{ij}$, and the B-pixel forming portion that is provided so as to correspond to the intersection of the B-source line $SLb_j$ and the gate line $GL_i$ is denoted by the characters $b_{ij}$.

Each selection block consists of three thin-film transistors, as shown in FIG. 4. In the following, the three thin-film transistors in the selection block 410(j) will be referred to respectively as the R-thin-film transistor 40r(j), the G-thin-film transistor 40g (j), and the B-thin-film transistor 40b(j) .

Each R-thin-film transistor is provided with the R-selection control signal CTr at a gate terminal, and is connected at a source terminal to an output signal line corresponding to the selection block that includes the R-thin-film transistor and at a drain terminal to an R-source line in a source line group corresponding to the selection block that includes the R-thin-film transistor. Each G-thin-film transistor is provided with the G-selection control signal CTg at a gate terminal, and is connected at a source terminal to an output signal line corresponding to the selection block that includes the G-thin-film transistor and at a drain terminal to a G-source line in a source line group corresponding to the selection block that includes the G-thin-film transistor. Each B-thin-film transistor is provided with the B-selection control signal CTb at a gate terminal, and is connected at a source terminal to an output signal line corresponding to the selection block that includes the B-thin-film transistor and at a drain terminal to a B-source line in a source line group corresponding to the selection block that includes the B-thin-film transistor.

Note that depending on the polarity of a video signal provided to the source terminal of the thin-film transistor in the selection block, the source terminal and the drain terminal of the thin-film transistor are switched with each other. However, descriptions herein will be given on the premise that, regardless of the polarity, in each thin-film transistor in the selection block, the terminal that is connected to the output signal line that corresponds to the selection block is the source terminal, and the terminal that is connected to the source signal line that corresponds to the selection block is the drain terminal.

The selection circuit 400 as above realizes the aforementioned operation of applying the video signals SS(1) to SS(k) to the source lines $SL_i$ to $SL_n$ in a time-division manner. Note that this operation will be described in detail later.

<1.4 Details of the Operation of the Liquid Crystal Display Device>

Figure 5:
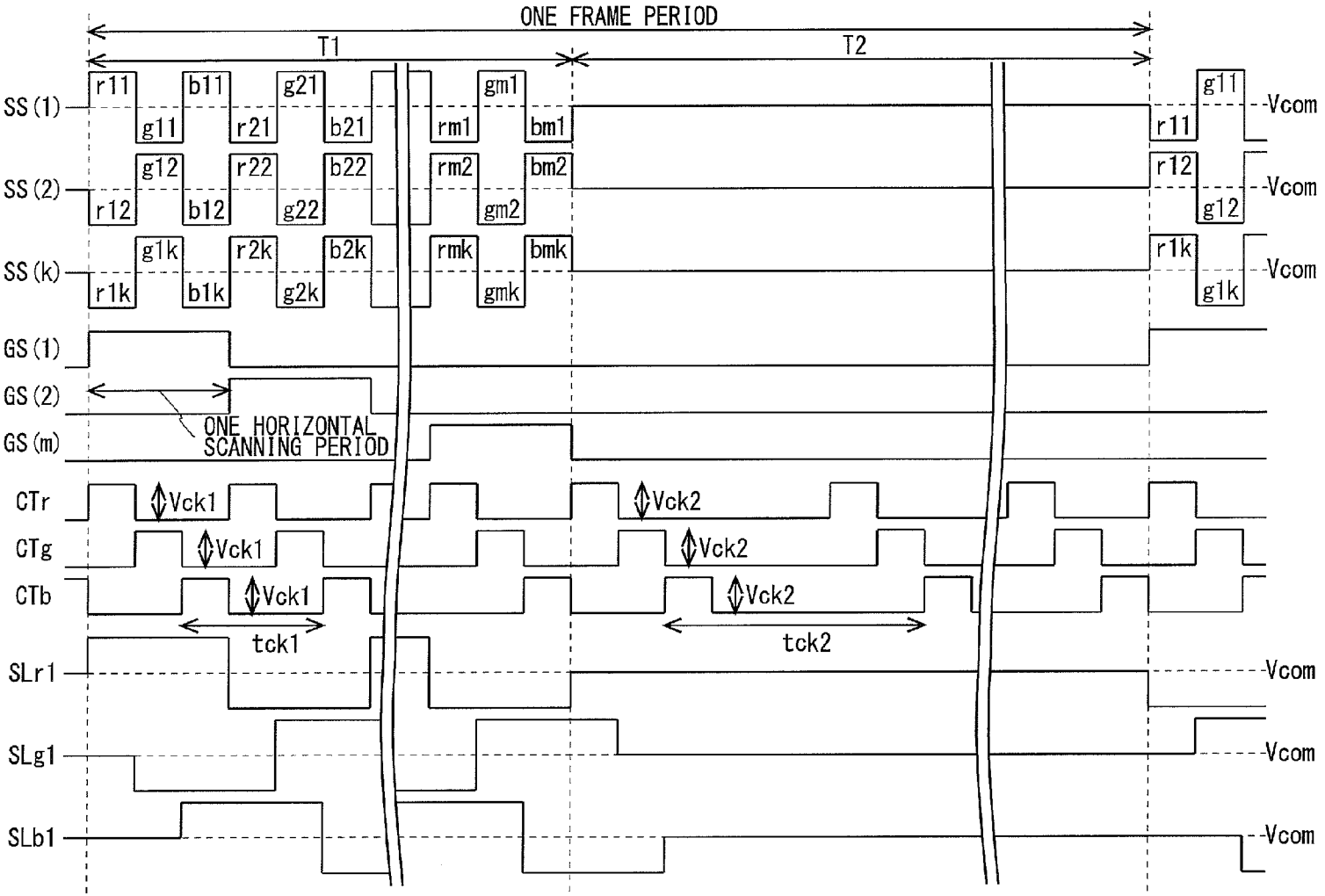
FIG. 5 is a signal waveform chart describing in detail the operation of the liquid crystal display device according to the first embodiment.

FIG. 5 is a signal waveform chart describing in detail the operation of the SSD liquid crystal display device according to the present embodiment. In the present embodiment, as shown in FIG. 5, one frame period consists of a scanning period T1 and an idle period T2 following the scanning period T1. In the scanning period T1, scanning signals GS(1) to GS(m) are sequentially set to high-level potential in accordance with a gate clock signal GCK. On the other hand, during the idle period T2, m gate lines $GL_1$ to $GL_m$ (scanning signals GS(1) to GS(m)) are all set at low-level potential.

<1.4.1 Operation during the Scanning Period>

The operation of the liquid crystal display device during the scanning period T1 will be described with reference to FIGS. 4 and 5. In the scanning period T1, the R-selection control signal CTr is set at high-level potential during the first switching selection period, the G-selection control signal CTg is set at high-level potential during the second switching selection period, and the B-selection control signal CTb is set at high-level potential during the third switching selection period, as shown in FIG. 5. Specifically, the cycle of each of the R-selection control signal CTr, the G-selection control signal CTg, and the B-selection control signal CTb during the scanning period T1 (referred to below as the "scanning period cycle") is one horizontal scanning period (three switching selection periods). Note that the scanning period cycle is denoted by the characters tck1. Moreover, the frequency of each of the R-selection control signal CTr, the G-selection control signal CTg, and the B-selection control signal CTb during the scanning period T1 (referred to below as the "scanning period frequency") is denoted by the characters fck1. Furthermore, the amplitude of each of the R-selection control signal CTr, the G-selection control signal CTg, and the B-selection control signal CTb during the scanning period T1 (referred to below as the "scanning period amplitude") is denoted by the characters Vck1.

As shown in FIG. 5, in the i'th horizontal scanning period of the scanning period T1, the video signal SS(j) is set at a potential that corresponds to the R-pixel forming portion $r_{ij}$ during the first switching selection period, it is set at a potential that corresponds to the G-pixel forming portion $g_{ij}$ during the second switching selection period, and it is set at a potential that corresponds to the B-pixel forming portion $b_{ij}$ during the third switching selection period. Note that in the present embodiment and other embodiments to be described later, polarity inversion drive is performed by inverting the polarity of each video signal every switching selection period, such that video signals being provided to adjacent output signal lines are opposite in polarity to each other, and also inverting the polarity of each video signal every frame period, but the present invention is not limited to this.

Initially, once the scanning signal GS(1) is set to high-level potential, the gate line GL1 is brought into a selected state, so that the R-pixel forming portion r1j, the G-pixel forming portion g1j, and the B-pixel forming portion b1j are brought into such a state that video signals can be written. In the following, the period for which the gate line GL1 is in the selected state will be referred to as the "first selection period".

In this case, in the first switching selection period, the R-selection control signal CTr is set to high-level potential, so that the R-thin-film transistor 40r(j) shown in FIG. 4 is brought into ON state. As a result, the video signal SS(j) at the potential that corresponds to the R-pixel forming portion $r_1$ is provided to the R-source line $SLr_j$. The potential of the R-source line $SLr_j$ (the video signal SS(j) at the potential that corresponds to the R-pixel forming portion $r_{1j}$) is written to the R-pixel forming portion $r_{1j}$. Note that in the first selection period, the polarity of the odd-row R-source line $SLr_j$ changes to positive, and the polarity of the even-row R-source line $SLr_j$ changes to negative. During the first switching selection period, the G-source line $SLg_j$ and the B-source line $SLb_j$ maintain the same potential (Vcom potential) as that during the preceding idle period T2.

In the second switching selection period, the G-selection control signal CTg is set to high-level potential, so that the G-thin-film transistor 40g($_j$) shown in FIG. 4 is brought into ON state. As a result, the video signal SS($_j$) at the potential that corresponds to the G-pixel forming portion $g_{1j}$ is provided to the G-source line $SLg_j$. The potential of the G-source line $SLg_j$ (the video signal SS($_j$) at the potential that corresponds to the G-pixel forming portion $g_{1j}$) is written to the G-pixel forming portion $g_{1j}$. Note that in the first selection period, the polarity of the odd-row G-source line $SLg_j$ changes to negative, and the polarity of the even-row G-source line $SLg_j$ changes to positive. During the second switching selection period, the R-source line $SLr_j$ and the B-source line $SLb_j$ maintain the same potential as that during the first switching selection period.

In the third switching selection period, the B-selection control signal CTb is set to high-level potential, so that the B-thin-film transistor 40b($_j$) shown in FIG. 4 is brought into ON state. As a result, the video signal SS($_j$) at the potential that corresponds to the B-pixel forming portion $b_{1j}$ is provided to the B-source line $SLb_j$. The potential of the B-source line $SLb_j$ (the video signal SS($_j$) at the potential that corresponds to the B-pixel forming portion $b_{1j}$) is written to the B-pixel forming portion $b_{1j}$. Note that in the first selection period, the polarity of the odd-row B-source line $SLb_j$ changes to positive, and the polarity of the even-row B-source line $SLb_j$ changes to negative. During the third switching selection period, the R-source line $SLr_j$ and the G-source line $SLg_j$ maintain the same potential as that during the second switching selection period.

The operation during the scanning period T1 is realized by repeating such a horizontal scanning period (three switching selection periods) as above.

<1.4.2 Operation during the Idle Period>

Next, the operation of the liquid crystal display device during the idle period T2 will be described with reference to FIGS. 4 and 5. In the present embodiment and other embodiments to be described later, the idle period T2 is set longer than the scanning period T1. However, the present invention is not limited to this, and the idle period T2 may be shorter than the scanning period T1.

As shown in FIG. 5, in the idle period T2, the R-selection control signal CTr is set at high-level potential during the first switching selection period, the G-selection control signal CTg is set at high-level potential during the second switching selection period, the B-selection control signal CTb is set at high-level potential during the third switching selection period, and the cycle of each signal is longer than the scanning period cycle tck1 . In the following, the cycle of each of the R-selection control signal CTr, the G-selection control signal CTg, and the B-selection control signal CTb during the idle period T2 (referred to below as the "idle period cycle") will be denoted by the characters tck2 . Moreover, the frequency of each of the R-selection control signal CTr, the G-selection control signal CTg, and the B-selection control signal CTb during the idle period T2 (referred to below as the "idle period frequency") is denoted by the characters fck2. Furthermore, the amplitude of each of the R-selection control signal CTr, the G-selection control signal CTg, and the B-selection control signal CTb during the idle period T2 (referred to below as the "idle period amplitude") is denoted by the characters Vck2.

As described above, the idle period cycle tck2 is longer than the scanning period cycle tck1. That is, the idle period frequency fck2 is lower than the scanning period frequency fck1. Here, the scanning period frequency fck1 is desirably an integral multiple of the idle period frequency fck2 . As a result, the configuration of the display control circuit 200, for example, can be simplified. Moreover, the scanning period frequency fck1 is desirably twice or more than twice the idle period frequency fck2. In other words, the idle period frequency fck2 is desirably half or less than half the scanning period frequency fck1 . As a result, power to be consumed to drive the selection circuit 400 can be significantly reduced. Such control for the frequency (cycle) of the selection control signal CT is performed by, for example, the display control circuit 200. Note that in the present embodiment, the idle period amplitude Vck2 and the scanning period amplitude Vck1 are equal in magnitude.

As shown in FIG. 5, the video signal SS(j) is set at the Vcom potential during the idle period T2. Moreover, the scanning signals GS(1) to GS(m) are not set to high-level potential during the idle period T2, and therefore, no video signal is written to the R-pixel forming portion $r_{ij}$, the G-pixel forming portion $g_{ij}$, and the B-pixel forming portion $b_{ij}$.

Once the R-selection control signal CTr is set to high-level potential in the first switching selection period during the first section of the idle period T2 that has the same length as one horizontal scanning period (simply referred to below as the "horizontal scanning period"), the R-thin-film transistor 40r (j) shown in FIG. 4 is brought into ON state. As a result, the video signal SS(j) at the Vcom potential is provided to the R-source line $SLr_j$. Note that during the first switching selection period of the first horizontal scanning period, the G-source line $SLg_j$ and the B-source line $SLb_j$ maintain the same potential as that during the preceding scanning period T1.

Next, in the second switching selection period, the G-selection control signal CTg is set to high-level potential, so that the G-thin-film transistor 40g(j) shown in FIG. 4 is brought into ON state. As a result, the video signal SS(j) at the Vcom potential is provided to the G-source line $SLg_j$. Note that during the second switching selection period of the first horizontal scanning period, the R-source line $SLr_j$ maintains the Vcom potential, and the B-source line $SLb_j$ maintains the same potential as that during the preceding scanning period T1.

Next, in the third switching selection period, the B-selection control signal CTb is set to high-level potential, so that the B-thin-film transistor 40b(j) shown in FIG. 4 is brought into ON state. As a result, the video signal SS(j) at the Vcom potential is provided to the B-source line $SLb_j$. Note that during the third switching selection period, the R-source line SLr and the G-source line $SLg_j$ maintain the Vcom potential.

The operation during the idle period T2 is realized by repeating the foregoing every idle period cycle tck2. By the operation during the idle period T2, the Vcom potential is provided to the source lines every idle period cycle tck2.

<1.5 Review>

In the case where the liquid crystal display device with a monolithic selection circuit simply uses the drive method described in Patent Document 2, to keep the source lines at a predetermined potential (Vcom potential) during the idle period T2, it is conceivable that the thin-film transistors in the selection circuit 400 are maintained in OFF state during the idle period T2, or the video signals are set at the Vcom potential during the idle period T2 while the thin-film transistors are maintained in ON state.

However, when the thin-film transistors in the selection circuit 400 are maintained in OFF state during the idle period T2, the source lines are set in a floating state. As a result, the source lines become prone to the effect of noise or suchlike during the idle period T2. There is parasitic capacitance between the source lines and the pixel electrodes, and the pixel electrodes are also set in a floating state, so that noise on the source lines affects the pixel potentials as well through capacitive coupling. Accordingly, there is a possibility of a reduction in display quality. On the other hand, in the present embodiment, the potentials of the R-selection control signal CTr, the G-selection control signal CTg, and the B-selection control signal CTb are set to high level every idle period cycle tck2 during the idle period T2, so that the R-thin-film transistor, the G-thin-film transistor, and the B-thin-film transistor are brought into ON state, as described above. As a result, the Vcom potential is provided to the source lines every idle period cycle tck2. Therefore, in the present embodiment, the effect of noise or suchlike on the source lines is reduced during the idle period T2. Thus, it is possible to inhibit a reduction in display quality.

Furthermore, in the case where the video signals are set at the Vcom potential during the idle period T2 while the thin-film transistors in the selection circuit 400 are maintained in ON state, it is necessary to keep providing the high-level potential to the gate terminals of the thin-film transistors. Gate-bias stress is applied to the thin-film transistors for a long period of time, so that significant threshold variations occur in the thin-film transistors. As a result, the thin-film transistors are reduced in capability. On the other hand, in the present embodiment, the high-level potential is simply provided to the gate terminals of the thin-film transistors in the selection circuit 400 every idle period cycle tck2. As a result, in the present embodiment, the gate-bias stress to be applied to the thin-film transistors is reduced, so that threshold variations in the thin-film transistors are reduced. Thus, it is possible to inhibit a reduction in drive capability (reliability) of the thin-film transistors M2.

<1.6 Implementation Example>

In the present embodiment, for example, a-Si or an oxide semiconductor or suchlike can be used for the semiconductor layers of the thin-film transistors in the selection circuit 400. Note that the oxide semiconductor that is typically used is $InGaZnO_x$ (referred to below as "IGZO"), which is an oxide semiconductor mainly composed of indium, gallium, zinc, and oxygen, but the present invention is not limited to this. For example, the oxide semiconductor includes at least one of the following: indium, gallium, zinc, copper, silicon, tin, aluminum, calcium, germanium, and lead.

Figure 6:
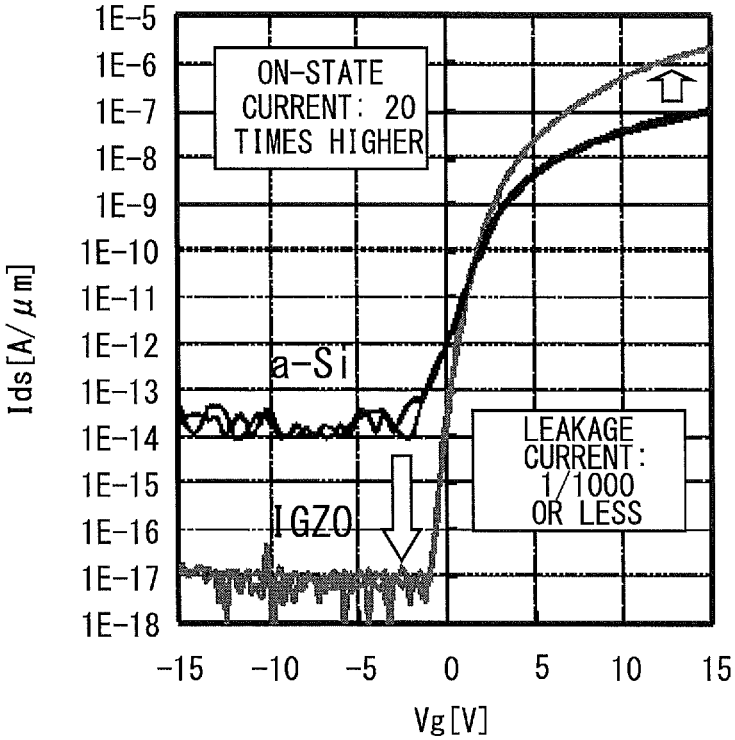
FIG. 6 is a graph showing drain current-gate voltage characteristics of an a-Si TFT and an IGZO TFT.

FIG. 6 is a graph showing drain current-gate voltage characteristics of an a-Si TFT and a TFT having a semiconductor layer made of IGZO (referred to below as an "IGZO TFT"). In FIG. 6, the horizontal axis represents gate voltage Vg, and the vertical axis represents drain current Ids. As shown in FIG. 6, the leakage current of the IGZO TFT is 1/1000 or lower than 1/1000 of the leakage current of the a-Si TFT, and the on-state current of the IGZO TFT is about twenty times higher than the on-state current of the a-Si TFT.

The leakage current of the IGZO TFT is low, as described above, and therefore, in the case where the IGZO TFT is used as the thin-film transistor in the selection circuit 400 in the present embodiment, the power for driving the selection circuit 400 can be reduced (to 1/100 or lower) compared to the case where the a-Si TFT is used as the thin-film transistor.

Furthermore, the on-state current of the IGZO TFT is high, as described above, and therefore, in the case where the IGZO TFT is used, the TFT size can be reduced to about 1/20 compared to the case where the a-Si TFT is used.

Note that in the case where the a-Si TFT is used, the present embodiment can be realized at lower cost than in the case where the IGZO TFT is used.

<1.7 Effect>

In the liquid crystal display device with a monolithic selection circuit of the present embodiment, the idle period T2 is set after the scanning period T1 within one frame period. The R-selection control signal CTr, the B-selection control signal CTb, and the G-selection control signal CTg are respectively provided to the R-thin-film transistor, the B-thin-film transistor, and the G-thin-film transistor, which are the thin-film transistors in the selection circuit 400, and their idle period frequency fck2 is lower than their scanning period frequency fck1, so that the frequency at which to drive the selection circuit 400 is reduced over the entire frame period. Thus, power consumption is reduced. Moreover, the selection circuit 400 is monolithically formed, resulting in a reduced frame area of the liquid crystal display panel 700 and reduced cost of the selection circuit 400.

Furthermore, in the present embodiment, the potentials of the R-selection control signal CTr, the B-selection control signal CTb, and the G-selection control signal CTg are set to high level every idle period cycle tck2 during the idle period T2, so that the R-thin-film transistor, the B-thin-film transistor, and the G-thin-film transistor are individually brought into ON state every idle period cycle tck2 . As a result, the effect of noise or suchlike on the source lines during the idle period T2 and threshold variations in the R-thin-film transistor, the B-thin-film transistor, and the G-thin-film transistor are reduced. Thus, it is possible to inhibit a reduction in display quality, and increase the reliability of the R-thin-film transistor, the B-thin-film transistor, and the G-thin-film transistor.

Furthermore, in the present embodiment, the idle period T2 is set longer than the scanning period T1, so that a further reduction in power consumption can be achieved.

In the case where the IGZO TFT is used as the thin-film transistor in the selection circuit 400 of the present embodiment, the idle period frequency fck2 can be set lower because the leakage current of the IGZO TFT is significantly low. As a result, power consumption can be reduced. Moreover, in this case, since the on-state current of the IGZO TFT is significantly high, the TFT size can be reduced to a significantly small value. Thus, a further reduction in frame area can be achieved.

On the other hand, in the case where the a-Si TFT is used as the thin-film transistor in the selection circuit 400 of the present embodiment, a further cost reduction can be achieved.

<1.8 Variant>

Figure 7:
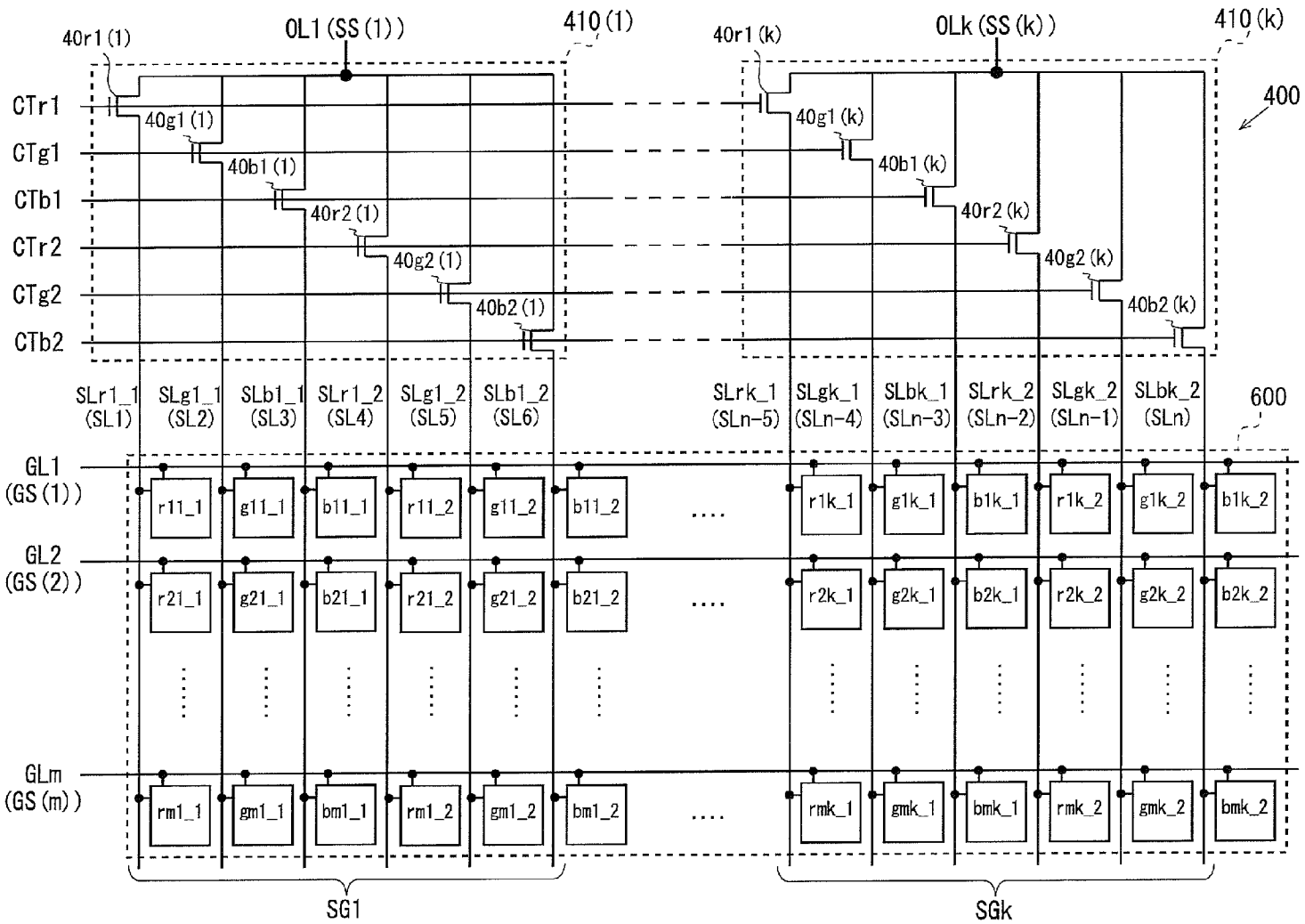
FIG. 7 is a circuit diagram describing the configuration of a selection circuit and the correspondence between selection blocks and source lines in a variant of the first embodiment.

FIG. 7 is a circuit diagram describing the configuration of the selection circuit 400 in a variant of the present embodiment and the correspondence between the selection blocks 410(1) to 410(k) and the source lines $SL_1$ to $SL_n$. The selection control signal CT consists of six phases of selection control signal CTr1, CTg1, CTb1, CTr2, CTg2, and CTb2. The selection control signals CTr1 and CTr2 correspond to the R-pixel forming portion, the selection control signals CTg1 and CTg2 correspond to the G-pixel forming portion, and the selection control signals CTb1 and CTb2 correspond to the B-pixel forming portion.

In this variant, the source line groups $SG_1$ to $SG_k$ are groups of six lines, as shown in FIG. 7. Here, the source line group $SG_j$ consists of six source lines $SL_{6j-5}$ to $SL_{6j-(j=1 \text{ to } k)}$. The source line groups $SG_1$ to $SG_k$ respectively correspond to the selection blocks 410(1) to 410(k).

Each source line group includes two source lines per color. In FIG. 7, the source line group $SG_j$ includes two R-source lines, the one (referred to below as the "first R-source line") and the other (referred to below as the "second R-source line") of the two being respectively denoted by the characters $SLr_{j_1}$ and $SLr_{j_2}$, two G-source lines, the one (referred to below as the "first G-source line") and the other (referred to below as the "second G-source line") of the two being respectively denoted by the characters $SLg_{j_1}$ and $SLg_{j_2}$, and two B-source lines, the one (referred to below as the "first B-source line") and the other (referred to below as the "second B-source line") of the two being respectively denoted by the characters $SLb_{j_1}$ and $SLb_{ij_2}$. Moreover, the R-pixel forming portion that is provided so as to correspond to the intersection of the first R-source line $SLr_{j_1}$ and the gate line $GL_I$ is denoted by the characters $r_{ij_1}$ (i=1 to m), the R-pixel forming portion that is provided so as to correspond to the intersection of the second R-source line $SLr_{j_2}$ and the gate line $GL_i$ is denoted by the characters $r_{ij_2}$ the G-pixel forming portion that is provided so as to correspond to the intersection of the first G-source line $SLg_{j_1}$ and the gate line $GL_i$ is denoted by the characters $g_{ij_1}$, the G-pixel forming portion that is provided so as to correspond to the intersection of the second G-source line $SLg_{j_2}$ and the gate line $GL_i$ is denoted by the characters $g_{ij_2}$, the B-pixel forming portion that is provided so as to correspond to the intersection of the first B-source line $SLb_{j_1}$ and the gate line $GL_i$ is denoted by the characters $b_{ij_1}$, and the B-pixel forming portion that is provided so as to correspond to the intersection of the second B-source line $SLb_{j_2}$ and the gate line $GL_i$ is denoted by the characters $b_{ij_2}$. In this manner, in the present variant, the six source lines in each source line group correspond to the three primary colors for two pixels (i.e ., 2×3 primary colors).

The selection block 410(j) consists of six thin-film transistors 40r1(j), 40g1(j) , 40b1(j), 40r2(j), 40g2(j), and 40b2(j) . The six thin-film transistors 40r1(j) , 40g1(j), 40b1(j), 40r2(j), 40g2(j), and 40b2(j) correspond to the first R-source line, the first G-source line, the first B-source line, the second R-source line, the second G-source line, and the second B-source line, respectively, in the source line group $SG_j$.

Figure 8:
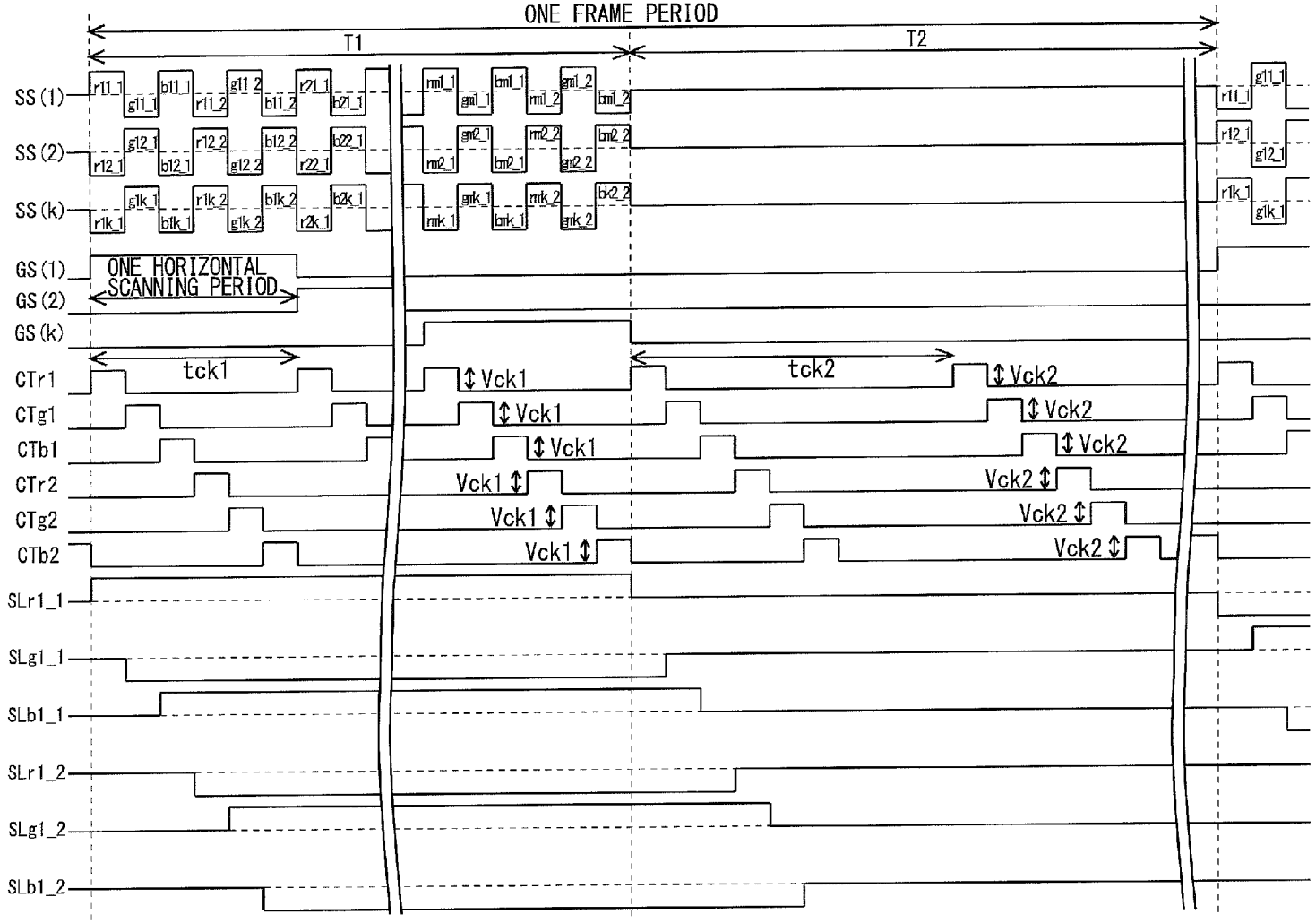
FIG. 8 is a signal waveform chart describing in detail the operation of a liquid crystal display device according to the variant of the first embodiment.

FIG. 8 is a signal waveform chart describing in detail the operation of the SSD liquid crystal display device according to the present variant. In the present variant, as shown in FIG. 8, one horizontal scanning period consisting of six switching selection periods is repeated during the scanning period T1, thereby providing a video signal to each video signal line. Note that the basic operation during the scanning period T1 is similar to that in the first embodiment, and therefore any description thereof will be omitted. Moreover, the basic operation during the idle period T2 is also similar to that in the first embodiment, and therefore any description thereof will be omitted.

In the present variant, the number of output terminals of the source driver 300 (the number of output signal lines) can be reduced compared to the first embodiment, so that a further cost reduction can be achieved.

<2. Second Embodiment>

<2.1 Operation During the Idle Period>

Figure 9:
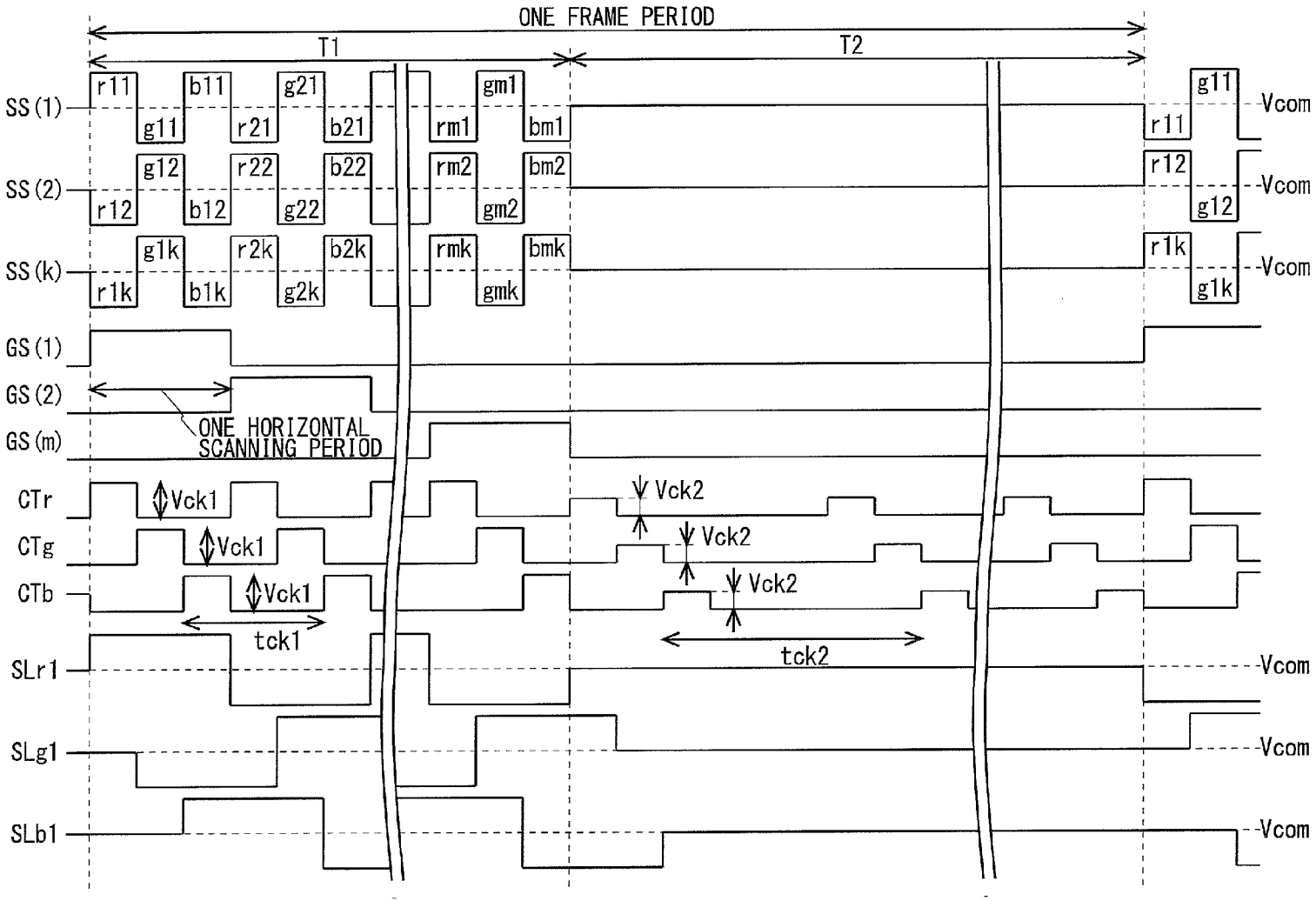
FIG. 9 is a signal waveform chart describing in detail the operation of a liquid crystal display device in a second embodiment of the present invention.

FIG. 9 is a signal waveform chart describing in detail the operation of a liquid crystal display device according to a second embodiment of the present invention. The present embodiment is the same as the first embodiment except for the operation during the idle period, and therefore any description of their similarities will be omitted. In the present embodiment, the idle period amplitude Vck2 is less than the scanning period amplitude Vck1 . Note that to reliably bring each thin-film transistor in the selection circuit 400 into ON state during the idle period T2, the idle period amplitude Vck2 needs to be greater than a threshold voltage for the thin-film transistor. Specifically, in the present embodiment, the idle period amplitude Vck2 is less than the scanning period amplitude Vck1 but greater than the threshold voltage for the thin-film transistor in the selection circuit 400.

<2.2 Effect>

In the present embodiment, the idle period amplitude Vck2, which is the amplitude of each of the R-selection control signal CTr, the G-selection control signal CTg, and the B-selection control signal CTb during the idle period T2, is less than the scanning period amplitude Vck1, which is the amplitude of each of the R-selection control signal CTr, the G-selection control signal CTg, and the B-selection control signal CTb during the scanning period T1. Thus, a further reduction in power consumption can be achieved. Moreover, there is a further reduction in the gate-bias stress that is applied to the R-thin-film transistor, the G-thin-film transistor, and the B-thin-film transistor during the idle period T2, resulting in higher reliability of the R-thin-film transistor, the G-thin-film transistor, and the B-thin-film transistor.

<3. Third Embodiment>

<3.1 Configuration of the Selection Circuit>

Figure 10:
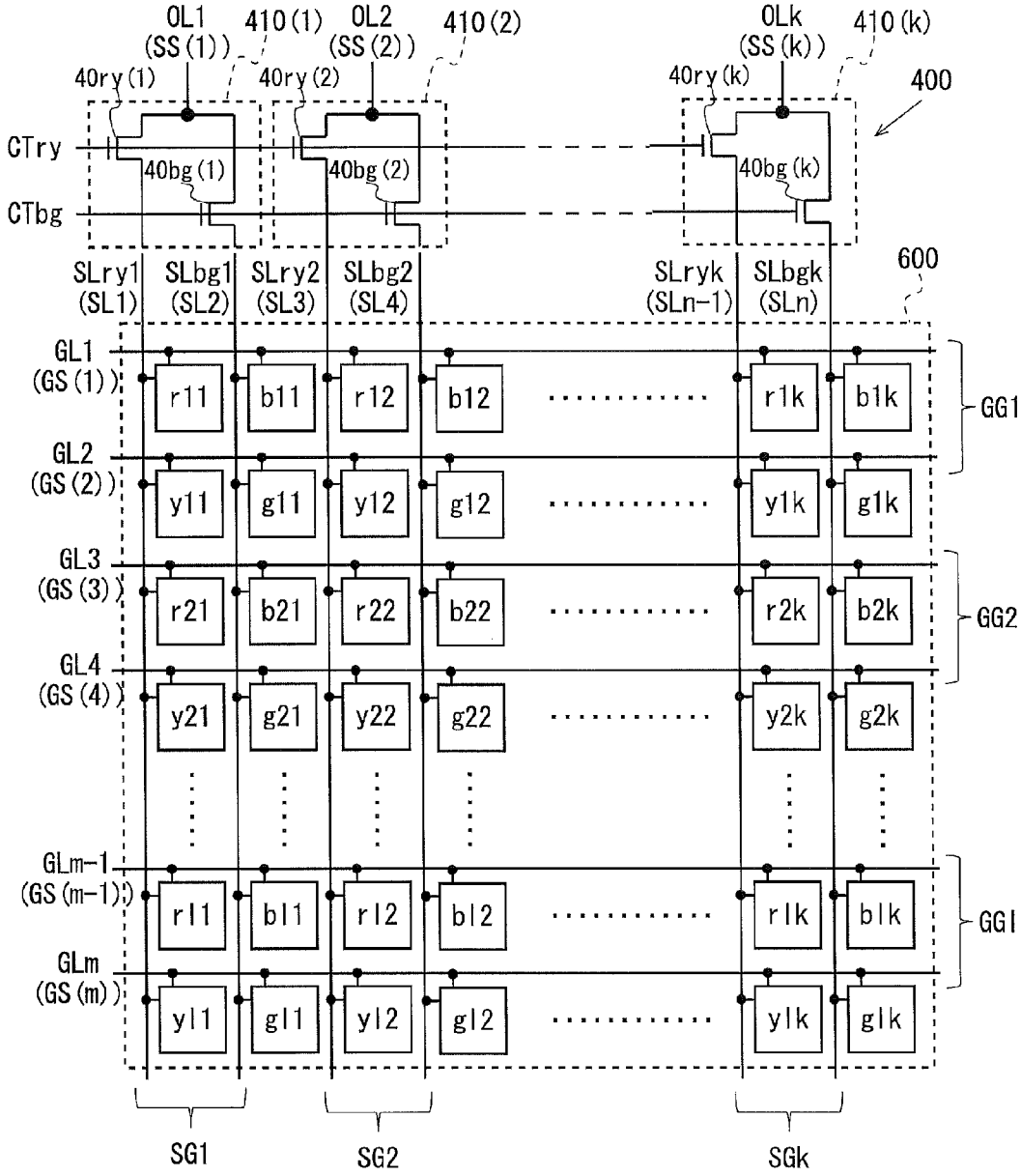
FIG. 10 is a circuit diagram describing the configuration of a selection circuit and the correspondence between selection blocks and source lines in a third embodiment of the present invention.

FIG. 10 is a circuit diagram describing the configuration of the selection circuit 400 in a third embodiment of the present invention and the correspondence between the selection blocks 410(1) to 410(k) and the source lines $SL_1$ to $SL_n$. Note that the present embodiment is the same as the first embodiment except for the configuration of the selection circuit 400 and details of the operation of the liquid crystal display device, and therefore any descriptions of their similarities will be omitted. In the present embodiment, color image display based on the four primary colors R, G, B, and Y is provided. Accordingly, the pixel forming portions are divided into groups of four respectively corresponding to R, G, B, and Y. Each group forms one pixel. In the following, the pixel forming portion that corresponds to Y will be referred to as the "Y-pixel forming portion".

In the present embodiment, as shown in FIG. 10, the gate lines $GL_1$ to $GL_m$ are divided into groups $GG_1$ to $GG_1$. (1=m/2) of two gate lines . Here, the gate line group $GG_i$ consists of two gate lines $GL_{2i-1}$ and $GL_{2i}$. (i=1 to 1) . For each gate line group, each pixel consisting of R, G, B, and Y elements is realized by R- and B-pixel forming portions, which are provided so as to correspond to the antecedent gate line in that group, and Y- and G-pixel forming portions, which are provided so as to correspond to the subsequent gate line.

In the present embodiment, the selection control signal CT consists of two phases of selection control signal CTry and CTbg. The selection control signal CTry corresponds to the R- and Y-pixel forming portions, and the selection control signal CTbg corresponds to the B- and G-pixel forming portions. In the following, the selection control signal CTry will be referred to as the "RY-selection control signal", and the selection control signal CTbg will be referred to as the "BG-selection control signal". Moreover, for each of the RY-selection control signal CTry and the BG-selection control signal CTbg, a period after transition from low to high-level potential until transition from high to low-level potential will be referred to as a "switching selection period" for convenience sake. The RY-selection control signal CTry and the BG-selection control signal CTbg are out of phase by one switching selection period from each other, and each of them is set at high-level potential (Vdd potential) for one of the two switching selection periods (except during the idle period T2). In the present embodiment, two switching selection periods correspond to one horizontal scanning period.

As shown in FIG. 10, the selection circuit 400 in the present embodiment consists of k selection blocks 410(1) to 410(k), as in the first embodiment. The selection blocks 410(1) to 410(k) are respectively connected (correspond) to output signal lines $OL_1$ to $OL_k$. Moreover, in the present embodiment, each of the selection blocks 410(1) to 410(k) is connected to two different source lines. The selection block 410(j) is connected to source lines $SL_{2j-1}$ and SL (j=1 to k). Each selection block is provided with the RY-selection control signal CTry and the BG-selection control signal CTbg.

Furthermore, as shown in FIG. 10, the source lines $SL_1$ to SL, are divided into groups $SG_1$ to $SG_k$ of two source lines. Here, the source line group $SG_j$consists of two source lines $SL_{2j-1}$ and $SL_{2j}$. The source line groups $SG_1$ to $SG_k$ respectively correspond to the selection blocks 410(1) to 410(k).

In FIG. 10, for the source line group $SG_j$, the source line that corresponds to R and Y (referred to below as the "RY-source line") is denoted by the characters $SLry_j$, and the source line that corresponds to B and G (referred to below as the "BG-source line") is denoted by the characters $SLbg_j$. Moreover, the R-pixel forming portion that is provided so as to correspond to the intersection of the RY-source line $SLry_j$ and the gate line $GL_{2i-1}$ is denoted by the characters $r_{ij}$, the B-pixel forming portion that is provided so as to correspond to the intersection of the BG-source line $SLbg_j$ and the gate line $GL_{2i-1}$ is denoted by the characters $b_{ij}$, the Y-pixel forming portion that is provided so as to correspond to the intersection of the RY-source line $SLry_i$ and the gate line $GL_{2i}$ is denoted by the characters $y_{ij}$, and the G-pixel forming portion that is provided so as to correspond to the intersection of the BG-source line $SLbg_j$ and the gate line $GL_{2i}$ is denoted by the characters $g_{ij}$.

Each selection block consists of two thin-film transistors, as shown in FIG. 10. In the following, the two thin-film transistors in the selection block 410(j) will be respectively referred to as the RY-thin-film transistor 40ry(j) and the BG-thin-film transistor 40bg(j).

The RY-thin-film transistor has a gate terminal to which the RY-selection control signal CTry is provided, a source terminal connected to an output signal line corresponding to the selection block that includes the RY-thin-film transistor, and a drain terminal connected to an RY-source line in the source line group corresponding to the selection block that includes the RY-thin-film transistor. The BG-thin-film transistor has a gate terminal to which the BG-selection control signal CTbg is provided, a source terminal connected to an output signal line corresponding to the selection block that includes the BG-thin-film transistor, and a drain terminal connected to a BG-source line in the source line group corresponding to the selection block that includes the BG-thin-film transistor.

The selection circuit 400 as above realizes the operation of applying the video signals SS(1) to SS(k) to the source line $SL_1$ to $SL_n$ in a time-division manner.

<3.2 Details of the Operation of the Liquid Crystal Display Device>

Figure 11:
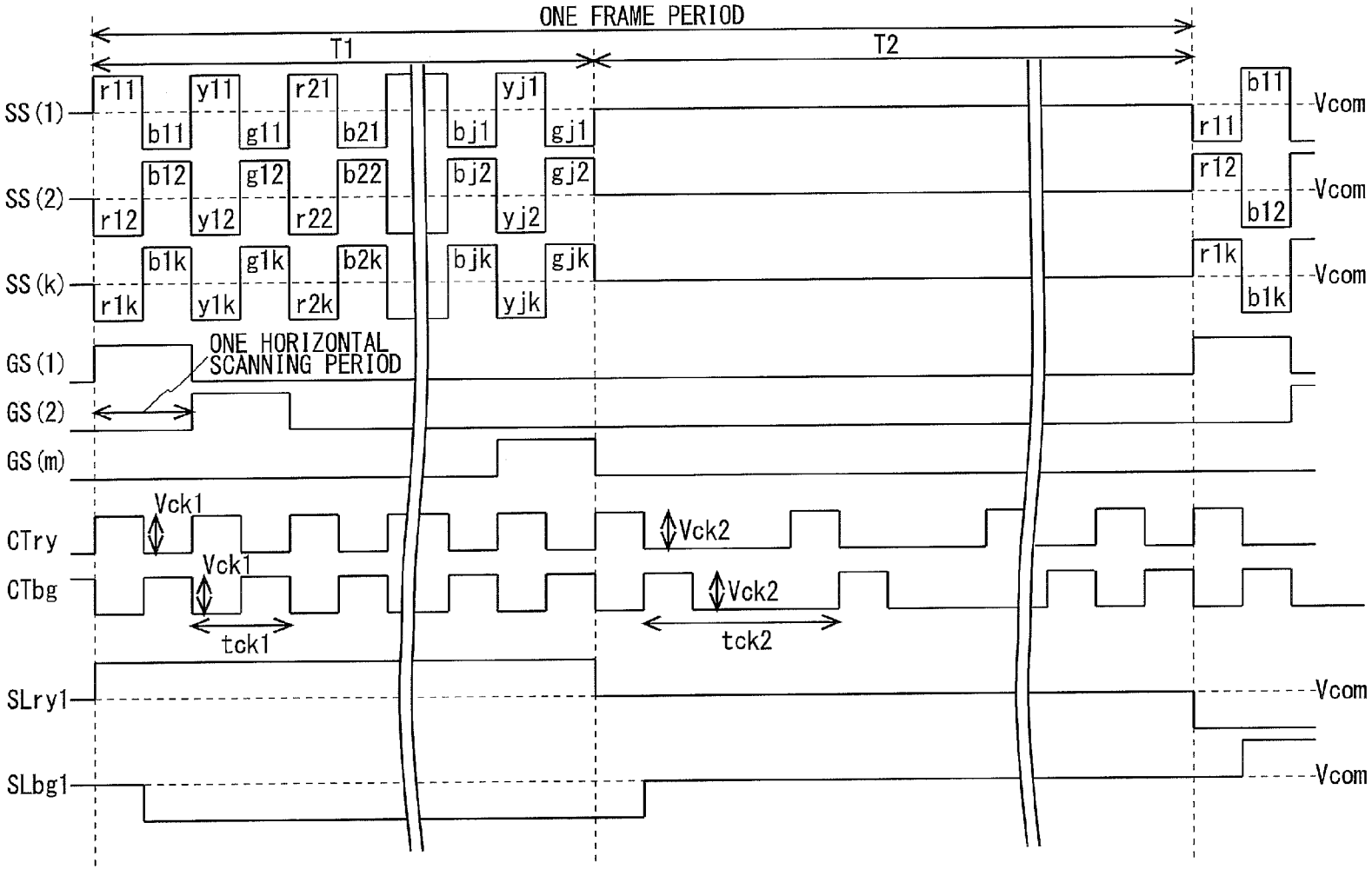
FIG. 11 is a signal waveform chart describing in detail the operation of a liquid crystal display device according to the third embodiment.

FIG. 11 is a signal waveform chart describing in detail the operation of the SSD liquid crystal display device according to the present embodiment.

<3.2.1 Operation during the Scanning Period>

The operation of the liquid crystal display device during the scanning period T1 will be described with reference to FIGS. 10 and 11. As shown in FIG. 11, in the scanning period T1, the video signals SS(1) to SS(k) are set at a potential that corresponds to the R-pixel forming portion during the first switching selection period of the former of two consecutive horizontal scanning periods, and they are set at a potential that corresponds to the B-pixel forming portion during the second switching selection period of the horizontal scanning period. Moreover, the video signals SS(1) to SS(k) are set at a potential that corresponds to the Y-pixel forming portion during the first switching selection period of the latter of the two consecutive horizontal scanning periods, and they are set at a potential that corresponds to the G-pixel forming portion during the second switching selection period of the horizontal scanning period.

In the scanning period T1, the RY-selection control signal CTry is set at high-level potential during the first switching selection period, and the BG-selection control signal CTbg is set at high-level potential during the second switching selection period. Specifically, the cycle of each of the RY-selection control signal CTry and the BG-selection control signal CTbg is one horizontal scanning period (two switching selection periods). As with the cycle of each of the R-selection control signal CTr, the G-selection control signal CTg, and the B-selection control signal CTb during the scanning period T1 in the first embodiment, the cycle of each of the RY-selection control signal CTry and the BG-selection control signal CTbg during the scanning period T1 in the present embodiment will also be referred to below as the "scanning period cycle tck1" . Moreover, as with the frequency of each of the R-selection control signal CTr, the G-selection control signal CTg, and the B-selection control signal CTb during the scanning period T1 in the first embodiment, the frequency of each of the RY-selection control signal CTry and the BG-selection control signal CTbg during the scanning period T1 in the present embodiment will also be referred to below as the "scanning period frequency fck1".

Initially, once the scanning signal GS(1) is set to high-level potential, the gate line $GL_1$ is brought into a selected state (the first selection period starts), so that the R-pixel forming portion $r_{ij}$ and the B-pixel forming portion are brought into such a state that video signals can be written.

In this case, in the first switching selection period, the RY-selection control signal CTry is set to high-level potential, so that the RY-thin-film transistor 40ry(j) shown in FIG. 10 is brought into ON state. As a result, the video signal SS (j) at the potential that corresponds to the R-pixel forming portion $r_{1j}$ is provided to the RY-source line $SLry_j$. The potential of the RY-source line $SLry_j$ (the video signal SS(j) at the potential that corresponds to the R-pixel forming portion $r_{1j}$) is written to the R-pixel forming portion $r_{ij}$. Note that in the first selection period, the polarity of the odd-row RY-source line $SLry_j$ changes to positive, and the polarity of the even-row RY-source line $SLry_j$ changes to negative. During the first switching selection period, the BG-source line $SLbg_j$ maintains the same potential (Vcom potential) as that during the preceding idle period T2.

In the second switching selection period, the BG-selection control signal CTbg is set to high-level potential, so that the BG-thin-film transistor 40bg(j) shown in FIG. 10 is brought into ON state. As a result, the video signal SS(j) at the potential that corresponds to the B-pixel forming portion $b_{1j}$ is provided to the BG-source line $SLbg_j$. The potential of the BG-source line $SLbg_j$ (the video signal SS(j) at the potential that corresponds to the B-pixel forming portion $b_{1j}$) is written to the B-pixel forming portion $b_{ij}$. Note that in the first selection period, the polarity of the odd-row BG-source line $SLbg_j$ changes to negative, and the polarity of the even-row BG-source line $SLbg_j$ changes to positive. During the second switching selection period, the RG-source line $SLry_j$ maintains the same potential as that during the first switching selection period.

Next, once the scanning signal GS(2) is set to high-level potential, the gate line $GL_2$ is brought into a selected state, so that the Y-pixel forming portion $y_{1j}$ and the G-pixel forming portion $g_{1j}$ are brought into such a state that video signals can be written. In the following, the period for which the gate line $GL_2$ is in the selected state will be referred to as the "second selection period".

In this case, as in the first switching selection period of the first selection period, the RY-thin-film transistor 40ry(j) is brought into ON state, and the video signal SS(j) at the potential that corresponds to the Y-pixel forming portion $y_{1j}$ is provided to the RY-source line $SLry_j$. The potential of the RY-source line $SLry_j$. (the video signal SS(j) at the potential that corresponds to the Y-pixel forming portion $y_{1j}$) is written to the Y-pixel forming portion $y_{1j}$. Note that the RY-source line $SLry_j$ has the same polarity as in the first selection period. In the first switching selection period, the BG-source line $SLbg_j$ maintains the same potential as that during the second switching selection period of the first selection period.

In the second switching selection period of the second selection period, as in the second switching selection period of the first selection period, the BG-thin-film transistor 40bg (j) is brought into ON state, and the video signal SS(j) at the potential that corresponds to the G-pixel forming portion is provided to the BG-source line $SLbg_j$. The potential of the BG-source line SLbg (the video signal SS(j) at the potential that corresponds to the G-pixel forming portion $g_{1j}$) is written to the G-pixel forming portion Note that the BG-source line $SLbg_j$ has the same polarity as in the first selection period. During the second switching selection period, the RY-source line $SLr_j$ maintains the same potential as that during the first switching selection period of the second selection period.

The operation during the scanning period T1 in the present embodiment is realized by repeating the two horizontal scanning periods (four switching selection periods) as above.

<3.2.2 Operation during the Idle Period>

Next, the operation of the liquid crystal display device during the idle period T2 will be described with reference to FIGS. 10 and 11. As shown in FIG. 11, in the idle period T2, the RY-selection control signal CTry is set at high-level potential during the first switching selection period, the BG-selection control signal CTbg is set at high-level potential during the second switching selection period, and the cycle of each signal is longer than the scanning period cycle tck1. As with the cycle of each of the R-selection control signal CTr, the G-selection control signal CTg, and the B-selection control signal CTb during the idle period T2 in the first embodiment, the cycle of each of the RY-selection control signal CTry and the BG-selection control signal CTbg during the idle period T2 in the present embodiment will be referred to below as the "idle period cycle tck2". Moreover, as with the frequency of each of the R-selection control signal CTr, the G-selection control signal CTg, and the B-selection control signal CTb during the idle period T2 in the first embodiment, the frequency of each of the RY-selection control signal CTry and the BG-selection control signal CTbg during the idle period T2 in the present embodiment will be referred to below as the "idle period frequency fck2".

In the present embodiment, as in the first embodiment, the idle period cycle tck2 is longer than the scanning period cycle tck1. That is, the idle period frequency fck2 is lower than the scanning period frequency fck1 . Note that the relationship between the scanning period frequency fck1 and the idle period frequency fck2 is the same as in the first embodiment, and therefore any description thereof will be omitted.

As shown in FIG. 11, the video signal SS(j) is at the Vcom potential. Moreover, the scanning signals GS(1) to GS(m) are not set to high-level potential during the idle period T2, so that no video signal is written to the R-pixel forming portion $r_{ij}$, the G-pixel forming portion $g_{ij}$, the B-pixel forming portion $b_{ij}$, and the Y-pixel forming portion $y_{ij}$.

In the first horizontal scanning period of the idle period T2, once the RY-selection control signal CTry is set to high-level potential in the first switching selection period, the RY-thin-film transistor 40ry(j) shown in FIG. 10 is brought into ON state. As a result, the video signal SS(j) at the Vcom potential is provided to the RY-source line $SLry_j$. Note that during the first switching selection period of the first horizontal scanning period, the BG-source line $SLbg_j$ maintains the same potential as that during the preceding scanning period T1.

In the second switching selection period, the BG-selection control signal CTbg is set to high-level potential, so that the BG-thin-film transistor 40bg(j) shown in FIG. 10 is brought into ON state. As a result, the video signal SS(j) at the Vcom potential is provided to the BG-source line $SLbg_j$. Note that the RY-source line $SLry_j$ maintains the Vcom potential during the second switching selection period.

The operation during the idle period T2 is realized by repeating the foregoing every idle period cycle tck2. By the operation during the idle period T2, the Vcom potential is provided to the source lines every idle period cycle tck2.

<3.3 Effect>

The present embodiment allows a similar effect to that achieved in the first embodiment to be achieved in a liquid crystal display device in which each pixel consisting of R, G, B, and Y elements is formed across two gate lines.

<4. Fourth Embodiment>

<4.1 Configuration of the Selection Circuit>

Figure 12:
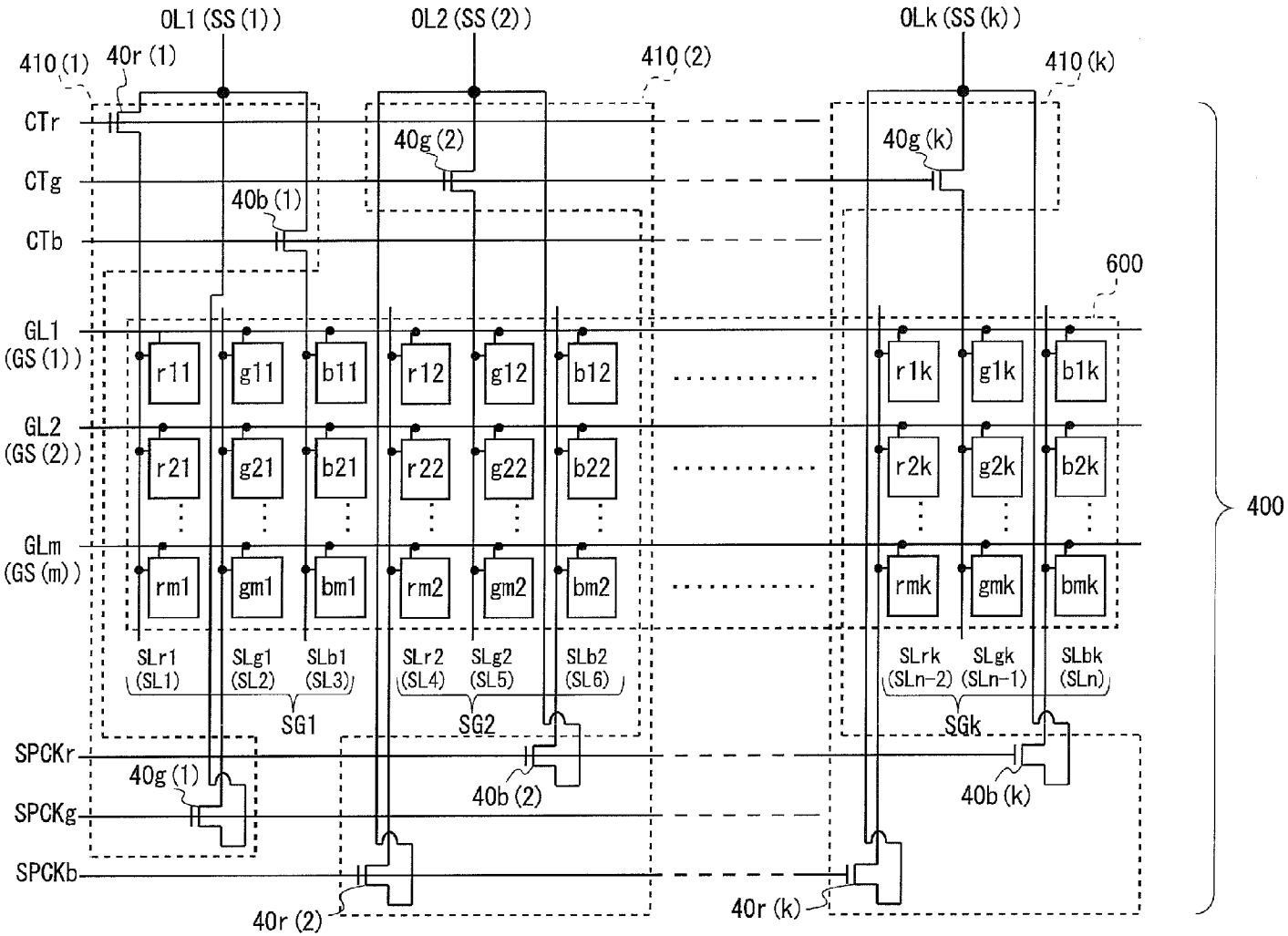
FIG. 12 is a circuit diagram describing the configuration of a selection circuit and the correspondence between selection blocks and source lines in a fourth embodiment of the present invention.

FIG. 12 is a circuit diagram describing the configuration of the selection circuit 400 in a fourth embodiment of the present invention. Note that the present embodiment is the same as the first embodiment except for the configuration of the selection circuit 400, and therefore any descriptions of their similarities will be omitted. As shown in FIG. 12, the selection circuit 400 in the present embodiment consists of two separate parts on both sides (in FIG. 12, the top and the bottom) of the display portion 600. In the following, the side on which the source driver 300 is disposed will be referred to as the "top side" with respect to the display portion 600, and the opposite side to the top side will be referred to as the "bottom side" with respect to the display portion 600. The upper part of the selection circuit 400 above the display portion 600 (referred to below as the "first selection circuit") corresponds to a first selection circuit, and the lower part below the display portion 600 (referred to below as the "second selection circuit") corresponds to a second selection circuit. In the present embodiment, the first selection circuit and the second selection circuit share selection blocks. More specifically, the selection blocks in the selection circuit 400 are separately arranged on the top and the bottom side of the display portion 600.

Odd selection blocks counted from the side where the gate driver 500 is disposed consist of R- and B-thin-film transistors disposed on the top side and G-thin-film transistors disposed on the bottom side. Even selection blocks counted from the side where the gate driver 500 is disposed consist of G-thin-film transistors disposed on the top side and R- and B-thin-film transistors disposed on the bottom side. Note that video signals are provided to the source terminals of the R-, G-, and B-thin-film transistors disposed on the bottom side, via lines extending from the top to the bottom of the display portion 600. The connections of the thin-film transistors and the signals that are provided to the thin-film transistors are the same as in the first embodiment, and therefore any descriptions thereof will be omitted.

<4.2 Effect>

In the present embodiment, the number of thin-film transistors in the selection circuit 400 that are required above the display portion 600 and the number of those required below the display portion 600 are each about half of the number of thin-film transistors in the selection circuit 400 of the first embodiment (the size of each of the first and second selection circuits is about half the size of the selection circuit). As a result, the layout pitch in the direction in which the gate line extends is doubled. Thus, it is possible to support, for example, higher-definition liquid crystal display panels.

<5 Other>

In the third embodiment, color image display is provided on the basis of a combination of the four primary colors R, G, B, and Y, but the present invention is not limited to this. The present invention can also be applied to color image display based on another combination of four primary colors, e.g., R, G, B, and W.

In the fourth embodiment, each source line group may consist of, for example, 9, 12, or 15 source lines or more. In such a case, each selection block consists of as many thin-film transistors as the number of source lines that constitute the source line group.

Each of the embodiments has been described on the premise that all of the thin-film transistors are of an n-channel type, but the present invention is not limited to this. The present invention can also be applied to the case where the thin-film transistors are of a p-channel type.

Each of the embodiments has been described taking the liquid crystal display device as an example, but the present invention is not limited to this. The present invention can also be applied to other display devices such as organic EL (Electro Luminescence) display devices. Moreover, various other modifications can be made to the embodiments without departing from the scope of the present invention.

Thus, it is possible to provide an SSD display device with reduced power consumption and a method for controlling selection circuits in the display device.

Industrial Applicability

The present invention can be applied to SSD display devices.

DESCRIPTION OF THE REFERENCE CHARACTERS

40x($_j$) thin-film transistor (x=r, g, b, ry or bg)
40x1($_j$), 40x2($_j$) thin-film transistor (x=r, g or b)
200 display control circuit
300 source driver (video signal line driver circuit)
400 sampling switch circuit (selection circuit)
410($_j$) selection block
500 gate driver (scanning signal line driver circuit)
600 display portion
700 liquid crystal display panel
CTx selection control signal (x=r, g, b, ry or bg)
$CTx_1$, $CTx_2$ selection control signal (x=r, g or b)
$SLx_j$ source line (video signal line) (x=r, g, b, ry or bg)
$SLx_{j_1}$, $SLx_{j_2}$ source line (video signal line) (x=r, g or b)
$SG_j$ source line group (video signal line group)
$x_{ij}$ pixel forming portion (x=r, g, b or y)
$x_{ij_1}$, $X_{ij_2}$ pixel forming portion (x=r, g or b)
T1 scanning period
T2 idle period
tck1 scanning period cycle
tck2 idle period cycle
fck1 scanning period frequency
fck2 idle period frequency
Vck1 scanning period amplitude
Vck2 idle period amplitude
Vss low-level direct-current power source potential
Vdd high-level direct-current power source potential

The invention claimed is:

1. A display device comprising:

a display portion that includes a plurality of video signal lines and a plurality of scanning signal lines crossing the video signal lines;

a scanning signal line driver circuit that drives the scanning signal lines such that a scanning period in which the scanning signal lines are sequentially selected and an idle period in which none of the scanning signal lines is selected alternatingly occur in cycles of a frame period consisting of the scanning period and the idle period;

a selection circuit that is integrally formed with the display portion and includes a plurality of selection blocks;

a video signal line driver circuit that provides the selection blocks with their respective video signals; and a display control circuit that provides the video signal line driver circuit with image data corresponding to the video signals and provides the selection blocks with a plurality of selection control signals cyclically repeating on-state and off-state levels, wherein, each selection block provides the video signal received thereby to video signal lines that are adjacent to each other in a video signal line group in a time-division manner in accordance with the selection control signals, the video signal line group consisting of as many video signal lines as the number of selection control signals, and the display control circuit generates the selection control signals so as to keep the selection control signals at a lower frequency during the idle period than during the scanning period.

2. The display device according to claim 1, wherein the display control circuit generates the selection control signals so as to keep the selection control signals in a smaller amplitude during the idle period than during the scanning periods.

3. The display device according to claim 1, wherein the idle period is longer than the scanning period.

4. The display device according to claim 1, wherein the video signal line driver circuit sets the video signals at a constant potential during the idle period.

5. The display device according to claim 1, wherein, each selection block has a plurality of switching elements with their respective first conductive terminals connected to the video signal lines in the video signal line group that corresponds to that selection block, a video signal received by each selection block is provided to second conductive terminals of the switching elements in that selection block, and the display control circuit provides the selection control signals to the switching elements in the selection block.

6. The display device according to claim 5, wherein, the display portion displays an image based on a plurality of primary colors, and the video signal lines in each video signal line group respectively correspond to the primary colors.

7. The display device according to claim 6, wherein, the number of the primary colors is three, each video signal line group consists of three video signal lines, each selection block has three switching elements, and the three video signal lines in each video signal line group respectively correspond to the three primary colors.

8. The display device according to claim 5, wherein, the display portion displays an image based on a plurality of primary colors, and the video signal lines in each video signal line group respectively correspond to as many primary colors from among a predetermined number of primary colors greater than the number of video signal lines in the video signal line group, and also respectively correspond to the same number of other primary colors from among the predetermined number of primary colors.

9. The display device according to claim 8, wherein, the number of the primary colors is four, each video signal line group consists of two video signal lines, each selection block has two switching elements, and the two video signal lines in each video signal line group respectively correspond to two of the four primary colors and also respectively correspond to the other two of the four primary colors.

10. The display device according to claim 5, wherein, the display portion displays an image based on a plurality of primary colors, and each video signal line group consists of video signal lines whose number is an integral multiple of the number of the primary colors.

11. The display device according to claim 10, wherein, the number of the primary colors is three, each video signal line group consists of six video signal lines, each selection block has six switching elements, and three of the video signal lines in each video signal line group respectively correspond to the three primary colors and the other three video signal lines in the video signal line group respectively correspond to the three primary colors.

12. The display device according to claim 1, wherein, the selection circuit consists of:

a first selection circuit positioned to one side of the display portion; and a second selection circuit positioned to the other side of the display portion.

13. The display device according to claim 1, wherein the selection circuit is implemented with thin-film transistors having semiconductor layers made of an oxide semiconductor.

14. The display device according to claim 13, wherein the oxide semiconductor includes indium, gallium, zinc and oxygen as a main component.

15. The display device according to claim 1, wherein the selection circuit is implemented with thin-film transistors having semiconductor layers made of amorphous silicon.

16. A drive method for a display device provided with a display portion that includes a plurality of video signal lines and a plurality of scanning signal lines crossing the video signal lines, a scanning signal line driver circuit that drives the scanning signal lines, a selection circuit that is integrally formed with the display portion and includes a plurality of selection blocks, a video signal line driver circuit that provides the selection blocks with their respective video signals, and a display control circuit that provides the video signal line driver circuit with image data corresponding to the video signals and provides the selection blocks with a plurality of selection control signals cyclically repeating on-state and off-state levels, the method comprising the steps of:

driving the scanning signal lines such that a scanning period in which the scanning signal lines are sequentially selected and an idle period in which none of the scanning signal lines is selected alternatingly occur in cycles of a frame period consisting of the scanning period and the idle period;

providing the video signal received by the selection block to video signal lines that are adjacent to each other in a video signal line group in a time-division manner in accordance with the selection control signals, the video signal line group consisting of as many video signal lines as the number of selection control signals; and keeping the selection control signals at a lower frequency during the idle period than during the scanning period.

17. The drive method according to claim 16, wherein the selection control signals are kept in a smaller amplitude during the idle period than during the scanning periods.

18. The drive method according to claim 16, wherein the idle period is longer than the scanning period.

19. The drive method according to claim 16, wherein the video signals are set at a constant potential during the idle period.

* * * * *